US010026269B2

(12) United States Patent
Upton et al.

(10) Patent No.: US 10,026,269 B2
(45) Date of Patent: Jul. 17, 2018

(54) GAMING SYSTEMS AND METHODS FOR PROVIDING PROGRESSIVE AWARDS

(71) Applicant: IGT, Las Vegas, NV (US)

(72) Inventors: Bryan Upton, Hertfordshire (GB); Cameron A. Filipour, Las Vegas, NV (US)

(73) Assignee: IGT, Las Vegas, NV (US)

( * ) Notice: Subject to any disclaimer, the term of this patent is extended or adjusted under 35 U.S.C. 154(b) by 0 days.

(21) Appl. No.: 15/273,102

(22) Filed: Sep. 22, 2016

(65) Prior Publication Data

US 2018/0082530 A1 Mar. 22, 2018

(51) Int. Cl.
*G07F 17/32* (2006.01)

(52) U.S. Cl.
CPC ..... *G07F 17/3295* (2013.01); *G07F 17/3209* (2013.01); *G07F 17/3211* (2013.01); *G07F 17/3239* (2013.01); *G07F 17/3255* (2013.01); *G07F 17/3258* (2013.01); *G07F 17/3262* (2013.01); *G07F 17/3272* (2013.01); *G07F 17/3276* (2013.01); *G07F 17/3279* (2013.01)

(58) Field of Classification Search
CPC ..... G07F 17/3239; G07F 17/3276; G07F 17/3279; G07F 17/3295; G07F 17/3258
See application file for complete search history.

(56) References Cited

U.S. PATENT DOCUMENTS

| | | | |
|---|---|---|---|
| 4,837,728 | A | 6/1989 | Barrie et al. |
| 5,417,430 | A | 5/1995 | Breeding |
| 5,655,961 | A | 8/1997 | Acres et al. |
| 5,766,076 | A | 6/1998 | Pease et al. |
| 5,851,011 | A | 12/1998 | Lott |
| 5,855,515 | A | 1/1999 | Pease et al. |
| 5,876,284 | A | 3/1999 | Acres et al. |
| 5,885,158 | A | 3/1999 | Torango et al. |
| 6,024,642 | A | 2/2000 | Stupak |
| 6,110,043 | A | 8/2000 | Olsen |
| 6,146,273 | A | 11/2000 | Olsen |
| 6,203,430 | B1 | 3/2001 | Walker et al. |
| 6,210,275 | B1 | 4/2001 | Olsen |
| 6,224,482 | B1 | 5/2001 | Bennett |
| 6,231,445 | B1 | 5/2001 | Acres |
| 6,244,958 | B1 | 6/2001 | Acres |
| 6,312,333 | B1 | 11/2001 | Acres |
| 6,312,334 | B1 | 11/2001 | Yoseloff |
| 6,364,768 | B1 | 4/2002 | Acres et al. |
| 6,371,852 | B1 | 4/2002 | Acres |
| 6,375,567 | B1 | 4/2002 | Acres |
| 6,375,569 | B1 | 4/2002 | Acres |
| 6,406,369 | B1 | 6/2002 | Baerlocher et al. |

(Continued)

FOREIGN PATENT DOCUMENTS

| | | |
|---|---|---|
| WO | 2006/130597 | 12/2006 |
| WO | 2007/028108 | 3/2007 |

(Continued)

*Primary Examiner* — David Duffy

(74) *Attorney, Agent, or Firm* — Neal, Gerber & Eisenberg LLP

(57) ABSTRACT

In various embodiments, the gaming system determines which of a plurality of progressive awards a player qualifies to potentially win based on a level of skill demonstrated by the player in association with one or more plays of one or more skill-based games (or partial skill-based games).

21 Claims, 7 Drawing Sheets

| Tier | Progressive Award | Skill-Based Games Available to be Played |
|---|---|---|
| 204e<br>5 | 202e<br>$1,002,559 | 206k 206l 206m 206n<br>Game K, Game L, Game M, Game N |
| 204d<br>4 | 202d<br>$182,223 | 206h 206i 206j<br>Game H, Game I, Game J |
| 204c<br>3 | 202c<br>$24,557 | 206e 206f 206g<br>Game E, Game F, Game G |
| 204b<br>2 | 202b<br>$2,169 | 206c 206d<br>Game C, Game D |
| 204a<br>1 | 202a<br>$351 | 206a 206b<br>Game A, Game B |

(56) References Cited

U.S. PATENT DOCUMENTS 6,413,160 B1 7/2002 Vancura
6,454,651 B1 9/2002 Yoseloff
RE37,885 E 10/2002 Acres et al.
6,572,473 B1 6/2003 Baerlocher
6,599,193 B2 7/2003 Baerlocher et al.
6,607,441 B1 8/2003 Acres
6,645,075 B1 11/2003 Gatto et al.
6,692,003 B2 2/2004 Potter et al.
6,702,670 B2 3/2004 Jasper et al.
6,731,313 B1 5/2004 Kaminkow
6,752,717 B2 6/2004 Vancura
6,761,632 B2 7/2004 Bansemer et al.
6,780,103 B2 8/2004 Bansemer et al.
6,796,904 B2 9/2004 Yoseloff
6,811,482 B2 11/2004 Letovsky
6,852,027 B2 2/2005 Kaminkow et al.
6,863,606 B1 3/2005 Berg et al.
6,918,830 B2 7/2005 Baerlocher
6,939,226 B1 9/2005 Joshi
6,942,568 B2 9/2005 Baerlocher
RE38,812 E 11/2005 Acres et al.
6,974,385 B2 12/2005 Joshi et al.
6,984,174 B2 1/2006 Cannon et al.
6,988,732 B2 1/2006 Vancura
7,077,744 B2 7/2006 Cannon
7,077,746 B2 7/2006 Torango
7,175,521 B2 2/2007 Mcclintic
7,297,059 B2 11/2007 Vancura et al.
7,326,115 B2 2/2008 Baerlocher
7,338,365 B1 3/2008 Luciano, Jr.
7,357,716 B2 4/2008 Marks et al.
7,410,421 B2 8/2008 Mathis
7,419,430 B1 9/2008 Joshi et al.
7,507,156 B2 3/2009 Nicely
7,510,473 B2 3/2009 Thomas
7,568,973 B2 8/2009 Iddings et al.
7,572,182 B2 8/2009 Vancura
7,575,516 B2 8/2009 Olive
7,578,739 B2 8/2009 Gauselmann
7,582,014 B2 9/2009 Olive
7,585,223 B2 9/2009 Iddings et al.
7,597,621 B2 10/2009 Baerlocher
7,628,689 B2 12/2009 Snow
7,722,451 B2 5/2010 Hughs-Baird et al.
7,780,523 B2 8/2010 Baerlocher et al.
7,841,939 B2 11/2010 Baerlocher et al.
7,862,427 B2 1/2011 Nguyen et al.
8,092,302 B2 1/2012 Cuddy et al.
8,231,460 B2 7/2012 Gauselmann
8,328,631 B2 * 12/2012 Baerlocher ..... G07F 17/32 463/25
8,342,958 B2 1/2013 Cuddy et al.
8,435,111 B2 5/2013 Filipour et al.
8,602,883 B2 12/2013 Cuddy et al.
8,926,423 B2 * 1/2015 Filipour ..... G07F 17/32 463/16
9,177,444 B2 11/2015 Cuddy et al.
2002/0052232 A1 5/2002 Kaminkow
2002/0090990 A1 7/2002 Joshi et al.
2002/0090991 A1 7/2002 Robb
2002/0160825 A1 10/2002 Nicastro et al.
2003/0015838 A1 1/2003 Kelly et al.
2004/0029627 A1 2/2004 Hannan et al.
2004/0048644 A1 3/2004 Gerrard et al.
2005/0026664 A1 2/2005 Bansemer et al.
2005/0071023 A1 3/2005 Gilliland et al.
2005/0096121 A1 5/2005 Gilliland et al.
2005/0159207 A1 7/2005 Thomas
2005/0197179 A1 9/2005 Moshal
2006/0025195 A1 2/2006 Pennington et al.
2006/0030403 A1 2/2006 Lafky et al.
2006/0040735 A1 2/2006 Baerlocher
2006/0073897 A1 4/2006 Englman et al.
2006/0183535 A1 8/2006 Marks et al.
2006/0246979 A1 11/2006 Chim
2006/0249904 A1 11/2006 Matheson
2006/0279044 A1 12/2006 Pacey
2007/0026923 A1 * 2/2007 Muir ..... G07F 17/32 463/16
2007/0054733 A1 3/2007 Baerlocher
2007/0060271 A1 3/2007 Cregan et al.
2007/0060314 A1 3/2007 Berlocher et al.
2007/0060321 A1 3/2007 Vasquez et al.
2007/0072682 A1 3/2007 Crawford et al.
2007/0082725 A1 * 4/2007 Low ..... G07F 17/32 463/16
2007/0111786 A1 5/2007 Snow
2007/0184887 A1 8/2007 Cannon
2007/0184891 A1 8/2007 Thomas
2007/0191088 A1 8/2007 Breckner et al.
2007/0218975 A1 9/2007 Iddings et al.
2007/0218982 A1 * 9/2007 Baerlocher ..... G07F 17/32 463/27
2007/0298874 A1 12/2007 Baerlocher et al.
2007/0298875 A1 12/2007 Baerlocher et al.
2008/0020832 A1 1/2008 Iddings et al.
2008/0020833 A1 1/2008 Baerlocher et al.
2008/0020834 A1 1/2008 Breckner et al.
2008/0020846 A1 1/2008 Vasquez et al.
2008/0039191 A1 2/2008 Cuddy
2008/0090651 A1 4/2008 Baerlocher
2008/0108406 A1 5/2008 Oberberger
2008/0108410 A1 5/2008 Baerlocher
2008/0108423 A1 5/2008 Benbrahim et al.
2008/0108425 A1 5/2008 Oberberger
2008/0108430 A1 5/2008 Evans
2008/0108431 A1 5/2008 Cuddy et al.
2008/0111308 A1 5/2008 Snow
2008/0113714 A1 5/2008 Vallejo
2008/0113779 A1 5/2008 Cregan
2008/0125211 A1 5/2008 Plowman
2008/0139305 A1 6/2008 Vallejo et al.
2008/0176647 A1 7/2008 Acres
2008/0207304 A1 8/2008 Acres
2008/0207313 A1 8/2008 Acres
2008/0248851 A1 10/2008 Bloom
2008/0268953 A1 10/2008 Acres
2008/0311980 A1 12/2008 Cannon
2009/0011826 A1 1/2009 Acres
2009/0042645 A1 2/2009 Graham et al.
2009/0061975 A1 3/2009 Ditchev
2009/0061991 A1 3/2009 Popovich et al.
2009/0061997 A1 3/2009 Popovich et al.
2009/0061998 A1 3/2009 Popovich et al.
2009/0061999 A1 3/2009 Popovich et al.
2009/0075728 A1 3/2009 Acres
2009/0088244 A1 4/2009 Nicely et al.
2009/0093299 A1 4/2009 Acres
2009/0104986 A1 4/2009 Englman et al.
2009/0111561 A1 4/2009 Dewaal et al.
2009/0124354 A1 5/2009 Acres
2009/0124355 A1 5/2009 Acres
2009/0124357 A1 5/2009 Acres
2009/0124358 A1 5/2009 Acres
2009/0124362 A1 5/2009 Cuddy et al.
2009/0124363 A1 5/2009 Baerlocher et al.
2009/0124364 A1 5/2009 Cuddy et al.
2009/0124373 A1 5/2009 Acres
2009/0131145 A1 5/2009 Aoki
2009/0131156 A1 5/2009 Acres
2009/0131158 A1 5/2009 Brunet De Courssou et al.
2009/0215523 A1 8/2009 Acres
2009/0239604 A1 9/2009 Acres
2009/0239648 A1 9/2009 Acres
2009/0239660 A1 9/2009 Acres
2009/0239661 A1 9/2009 Acres
2009/0247267 A1 10/2009 Acres
2009/0247277 A1 10/2009 Caspers et al.
2009/0253487 A1 10/2009 Gagner et al.
2009/0264171 A1 10/2009 Acres
2009/0275375 A1 11/2009 Acres
2009/0305776 A1 12/2009 Englman et al.
2009/0318214 A1 12/2009 Acres
2009/0318215 A1 12/2009 Acres

(56) References Cited

U.S. PATENT DOCUMENTS

| | | | | |
|---|---|---|---|---|
| 2009/0318217 | A1 | 12/2009 | Acres | |
| 2010/0004047 | A1 | 1/2010 | Acres | |
| 2010/0004053 | A1 | 1/2010 | Acres | |
| 2010/0004054 | A1 | 1/2010 | Acres | |
| 2010/0004057 | A1 | 1/2010 | Acres | |
| 2010/0004058 | A1 | 1/2010 | Acres | |
| 2010/0062843 | A1 | 3/2010 | Gagner | |
| 2010/0120498 | A1 | 5/2010 | Cuddy et al. | |
| 2010/0304825 | A1 | 12/2010 | Davis et al. | |
| 2011/0118011 | A1* | 5/2011 | Filipour | G07F 17/32 463/27 |
| 2011/0212768 | A1* | 9/2011 | Baerlocher | G07F 17/32 463/27 |
| 2012/0445580 | | 5/2012 | Hornik | |
| 2012/0252562 | A1 | 10/2012 | Aoki | |
| 2013/0237313 | A1* | 9/2013 | Filipour | G07F 17/32 463/27 |
| 2014/0045580 | A1 | 2/2014 | Hawkins | |
| 2014/0274299 | A1 | 9/2014 | Kitamura | |
| 2014/0274349 | A1 | 9/2014 | Spencer | |
| 2015/0065234 | A1 | 3/2015 | Watkins | |
| 2015/0332558 | A1 | 11/2015 | Riggs et al. | |

FOREIGN PATENT DOCUMENTS

| | | |
|---|---|---|
| WO | 2007/117502 | 10/2007 |
| WO | 2008/021449 | 2/2008 |
| WO | 2008/033877 | 3/2008 |
| WO | 2008/060426 | 5/2008 |
| WO | 2008/060978 | 5/2008 |
| WO | 2008/143790 | 11/2008 |

* cited by examiner

FIG. 2

| Tier | Progressive Award | Skill-Based Games Available to be Played |
|---|---|---|
| 204e<br>5 | 202e<br>$1,002,559 | 206k 206l 206m 206n<br>Game K, Game L, Game M, Game N |
| 204d<br>4 | 202d<br>$182,223 | 206h 206i 206j<br>Game H, Game I, Game J |
| 204c<br>3 | 202c<br>$24,557 | 206e 206f 206g<br>Game E, Game F, Game G |
| 204b<br>2 | 202b<br>$2,169 | 206c 206d<br>Game C, Game D |
| 204a<br>1 | 202a<br>$351 | 206a 206b<br>Game A, Game B |

1000

GAMING SYSTEMS AND METHODS FOR PROVIDING PROGRESSIVE AWARDS

COPYRIGHT NOTICE

A portion of the disclosure of this patent document contains or may contain material which is subject to copyright protection. The copyright owner has no objection to the photocopy reproduction by anyone of the patent document or the patent disclosure in exactly the form it appears in the Patent and Trademark Office patent file or records, but otherwise reserves all copyright rights whatsoever.

BACKGROUND

Gaming machines which provide players awards in primary or base games are well known. Gaming machines generally require the player to place or make a wager to activate the primary or base game. In certain jurisdictions, such primary games are games of luck, not games of skill. For instance, an award for a wagered on play of a primary game is based on the player obtaining a randomly determined winning symbol or symbol combination. One reason these gaming machines are popular is because an amateur, novice or inexperienced player can play most gaming machines at the player's own pace, with no required skills, strategy or risk evaluation and perform as well as a seasoned or experienced player.

Certain other gaming machines include games such as video poker and blackjack which involve certain player strategy or decision-making. In these games, the player decides which cards to hold in draw-type poker games and whether to take additional cards in blackjack-type card games. These games generally require a certain level of strategy to be successful. Moreover, gaming machines in certain jurisdictions include games that involve a skill event, such as an event requiring player dexterity to be successful. These games do not generate outcomes purely upon a random determination, rather such games require player inputs of skill or strategy to determine success or failure.

Progressive awards associated with gaming machines are also known. In one form, a progressive award is an award amount which includes an initial amount funded by a casino and an additional amount funded through a portion of wagers made on the progressive gaming machines. The progressive award grows in value as players play the gaming machines and more portions of these wagers are allocated to the progressive award. When a player obtains a winning symbol or winning symbol combination associated with the progressive award, the accumulated progressive award is provided to the player. After the progressive award is provided to the player, the amount of the next progressive award is reset to the initial value and a portion of subsequent wagers on the gaming machine associated with the progressive award are allocated to the next progressive award.

While progressive awards are popular amongst players, certain players become discouraged by the frequency which such progressive awards are provided. For example, when a progressive award is not provided relatively frequently, a player may feel deflated that the progressive award will not hit for a long period of time and not wish to continue playing the gaming machine. In another example, after a progressive award is provided to a player, a player may not find the reset progressive award desirable or worth the cost of continuing to play. Such a decision to stop playing the gaming machine or not even start playing the gaming machine due to the above-described situations of jackpot fatigue presents a problem to gaming establishment operators.

There is thus a continuing need to provide new and different gaming machines which incorporate one or more aspects of skill in determining which awards, such as progressive awards, are provided to players.

There is also a continuing need to provide new and different gaming machines which cater to higher skilled players while still accommodating lesser skilled players when determining which awards, such as progressive awards, are provided to such players.

SUMMARY

The present disclosure relates generally to gaming systems and methods for providing progressive awards in association with one or more skill-based games.

In various embodiments, the gaming system disclosed herein determines which of a plurality of progressive awards a player qualifies to potentially win based on a level of skill demonstrated by the player in association with one or more plays of one or more skill-based games (or partial skill-based games). In certain such embodiments, the gaming system includes a persistence aspect wherein over the course of time and based, at least in part, on the skill exhibited by the player, the player advances to unlock different skill-based games (or partial skill-based games) and correspondingly advances to unlock or otherwise qualify for different progressive awards. Additionally, upon a triggering event associated with one of the progressive awards the player currently qualifies to potentially win, the gaming system disclosed herein enables the player to participate in a skill-based (or partial skill-based) progressive award sequence to determine whether or not to provide that progressive award to the player. In these embodiments, based, at least in part, on the skill exhibited by the player during the progressive award sequence (and potentially based on the skill exhibited by the player during the progressive award sequence relative to the skill exhibited by one or more other players during the progressive award sequence), the gaming system determines which player, if any, to provide the qualifying progressive award to. As such, the gaming system disclosed herein provides that each player, regardless of that player's skill level, is eligible to win at least one progressive award wherein the progressive award(s) associated with a player and the determination of if that player wins any associated progressive awards is at least partially based on the level of skill demonstrated by that player over one or more plays of one or more skill-based games (or partial skill-based games). Such a configuration thus caters to higher skilled players while still accommodating lesser skilled players when determining which awards, such as progressive awards, are provided to such players.

In various embodiments, the gaming system disclosed herein maintains a plurality of progressive awards. The gaming system also maintains a hierarchy or configuration of different tiers, levels or stages for a plurality of skill-based games. Each tier, level or stage is associated with one or more skill-based games (or partial skill-based games). Each tier, level or stage is also associated with at least one of the progressive awards. In these embodiments, the gaming system assigns a player to an initial tier, level or stage and enables the player to play one or more skill-based games associated with the currently assigned tier, level or stage. For the plays of such skill-based games, the player's level of skill (as determined based on or quantified by zero, one or more inputs made by the player which tend to measure one or more aspects of that player's skill) determine the outcomes of such plays of the skill-based games. Moreover, the outcomes of such plays of the skill-based games determine whether the player remains in the same tier, level or stage or advances to another tier, level or stage. As such, since different tiers, levels or stages are associated with different progressive awards and since the player advances from one tier, level or stage to another tier, level or stage based on the player's level of skill exhibited during the plays of such skill-based games, the gaming system disclosed herein includes a player advancing from eligibility to win one progressive award to eligibility to win another progressive award based on the player's level of skill exhibited during the plays of such skill-based games. The gaming system disclosed herein thus determines if a player qualifies to potentially win one or more progressive awards based on that player's level of skill and specifically based on that player's level of skill demonstrated across multiple plays of multiple skill-based games of differing tiers, levels or stages. Since each tier, level or stage is associated with at least one progressive award, such a configuration further provides that each player, regardless of the level of skill exhibited by that player, is eligible to win at least one of the progressive awards.

In various embodiments, in addition to utilizing a player's level of skill to determine one or more skill-based game outcomes and one or more progressive awards which the player is eligible to win, the gaming system disclosed herein further utilizes a player's level of skill to determine if the player wins any qualifying progressive awards. In these embodiments, upon an occurrence of a progressive award sequence triggering event associated with a progressive award of a tier, level or stage, the gaming system determines if any players are currently associated with that tier, level or stage. That is, the gaming system determine if any players have exhibited the requisite amount of player skill during the plays of the skill-based games to advance at least to the tier, level or stage of the progressive award associated with the occurrence of the progressive award sequence triggering event.

In these embodiments, if no players are currently associated with at least the tier, level or stage of the progressive award associated with the occurrence of the progressive award sequence triggering event, the gaming system determines not to trigger any progressive award sequence or provide that progressive award to any players in association with that occurrence of the progressive award sequence triggering event. Put differently, if no players have exhibited the requisite amount of player skill during the plays of the skill-based games to advance at least to the tier, level or stage of the progressive award associated with the occurrence of the progressive award sequence triggering event, the gaming system does not provide the progressive award to any unqualified players.

On the other hand, if one player is currently associated with at least the tier, level or stage of the progressive award associated with the occurrence of the progressive award sequence triggering event, the gaming system triggers a progressive award sequence for that one player. The progressive award sequence for the one player includes enabling the player to play one or more skill-based games to determine whether or not to provide the progressive award to that player. In such embodiments, the player's inputs (which tend to measure one or more aspects of that player's skill result) made during the plays of the skill-based games of the triggered progressive award sequence result in either the gaming system providing the progressive award to the player or not providing the progressive award to the player in association with that occurrence of the progressive award sequence triggering event. As such, if one player has exhibited the requisite amount of player skill during the plays of the skill-based games to advance at least to the tier, level or stage of the progressive award associated with the occurrence of the progressive award sequence triggering event, the gaming system enables the player to exhibit a further amount of player skill during the progressive award sequence to potentially be provided the progressive award.

In these embodiments, if a plurality of players are each currently associated with at least the tier, level or stage of the progressive award associated with the occurrence of the progressive award sequence triggering event, the gaming system triggers a progressive award sequence for each of the qualifying players. The progressive award sequence for the qualifying players includes enabling each of the players to play one or more skill-based games which determine whether that player will be selected to be provided the progressive award. In such embodiments, for each qualifying player, at least partially based on that player's inputs (which tend to measure one or more aspects of that player's skill result) made during the plays of the skill-based games of the triggered progressive award sequence, the gaming system determines a relative ranking or position for that player. Following the plays of the skill-based games of the triggered progressive award event, the gaming system determines which of the qualifying players wins the progressive award based at least in part on each player's determined ranking or position. As such, if a plurality of players each exhibited the requisite amount of player skill during the plays of the skill-based games to advance at least to the tier, level or stage of the progressive award associated with the occurrence of the progressive award sequence triggering event, the gaming system enables these players to each exhibit a further amount of player skill during the progressive award sequence, such as a further amount of skill during a skill-based tournament, to determine which one of these qualifying players will be provided the progressive award.

Accordingly, the gaming system disclosed herein: (i) determines whether a player is eligible to win one of a plurality of progressive awards based on zero, one or more inputs made by the player in one or more plays of one or more skill-based games, and (ii) subsequently determines whether to provide the progressive award that the player is currently eligible to win to that player based on zero, one or more inputs made the player in a skill-based progressive award sequence. Put differently, the gaming system disclosed herein first determines whether a player is eligible to win at least one of a plurality of progressive awards based on that player's level of skill (as determined based on zero, one or more skill measurable inputs made by the player over one or more plays of one or more skill-based games associated with one or more tiers, levels or stages). After determining the player's eligibility to win one of the progressive awards, upon the subsequent occurrence of a progressive award sequence triggering event, the gaming system determines whether or not the player wins that progressive award based on that player's level of skill (as determined based on zero, one or more skill measurable inputs made by the player over one or more plays of one or more skill-based games in association with a progressive award sequence). Such a configuration thus incorporates one or more aspects of skill in determining which awards, such as progressive awards, are provided to players.

Additional features and advantages are described herein, and will be apparent from the following Detailed Description and the figures.

BRIEF DESCRIPTION OF THE FIGURES

FIG. 2 is a chart illustrating an example of the different progressive awards and the different skill-based games associated with the different tiers.

DETAILED DESCRIPTION

Skill-Based Progressive Award Tiers

Figure 1A:
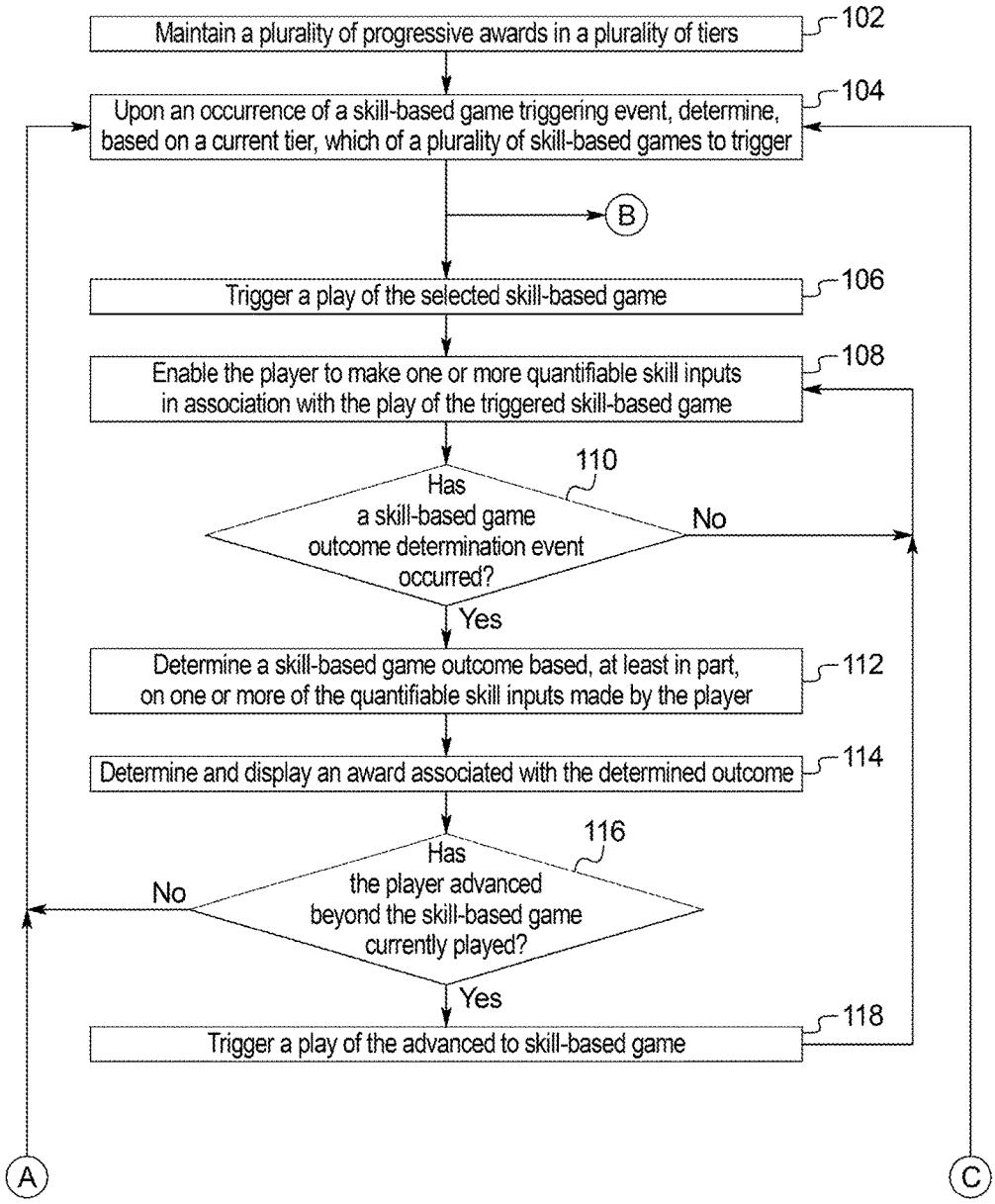
FIGS. 1A and 1B (collectively FIG. 1) is a flow chart an example process for operating a gaming system disclosed herein including determining progressive award eligibility based on one or more skill inputs made by a player and determining whether to provide a player a qualifying progressive award based on one or more skill inputs made by the player.

In various embodiments, the gaming system disclosed herein determines which of a plurality of progressive awards a player qualifies to potentially win based on a level of skill demonstrated by the player in association with one or more plays of one or more skill-based games (or partial skill-based games). In certain such embodiments, the gaming system includes a persistence aspect wherein over the course of time and based, at least in part, on the skill exhibited by the player, the player advances to unlock different skill-based games (or partial skill-based games) and correspondingly advances to unlock or otherwise qualify for different progressive awards. Additionally, upon a triggering event associated with one of the progressive awards the player currently qualifies to potentially win, the gaming system disclosed herein enables the player to participate in a skill-based (or partial skill-based) progressive award sequence to determine whether or not to provide that progressive award to the player. In these embodiments, based, at least in part, on the skill exhibited by the player during the progressive award sequence (and potentially based on the skill exhibited by the player during the progressive award sequence relative to the skill exhibited by one or more other players during the progressive award sequence), the gaming system determines which player, if any, to provide the qualifying progressive award to. As such, the gaming system disclosed herein provides that each player, regardless of that player's skill level, is eligible to win at least one progressive award wherein the progressive award(s) associated with a player and the determination of if that player wins any associated progressive awards is at least partially based on the level of skill demonstrated by that player over one or more plays of one or more skill-based games. Such a configuration thus caters to higher skilled players while still accommodating lesser skilled players when determining which awards, such as progressive awards, are provided to such players.

It should be appreciated that while certain of the embodiments described herein are directed to playing one or more primary skill-based games, such embodiments may additionally or alternatively be employed in association with playing one or more primary partial skill-based games, playing one or more secondary or bonus skill-based games or playing one or more secondary or bonus partial skill-based games. In these embodiments, a play of a partial skill-based game includes at least one skill component (a component which is determined based on or quantified by zero, one or more inputs made by the player which tend to measure one or more aspects of that player's skill) and at least one non-skill component (a component which is not determined based on or quantified by zero, one or more inputs made by the player which tend to measure one or more aspects of that player's skill).

It should be additionally appreciated that while certain of the embodiments described herein are directed to an individual or single player skill-based game, such embodiments may additionally or alternatively be employed in association with a group skill-based game or a group partial skill-based game. It should be further appreciated that while the player's credit balance, the player's wager, and any awards are, in certain of the below-described embodiments, an amount of monetary credits or currency, one or more of such player's credit balance, such player's wager, and any awards provided to such player may be for non-monetary credits, promotional credits, and/or player tracking points or credits.

It should also be appreciated that the below-described gaming system of the present disclosure includes different configurations of different components including, but not limited to: (i) one or more central servers, central controllers, or remote hosts; (i) one or more electronic gaming machines such as those located on a casino floor; and/or (ii) one or more personal gaming devices, such as desktop computers, laptop computers, tablet computers or computing devices, personal digital assistants, mobile phones, and other mobile computing devices. As such, the present disclosure provides a mixed channel environment wherein different players utilizing different gaming platforms powered via different gaming system components participate in one or more games to win one or more awards as disclosed herein.

Figure 1B:
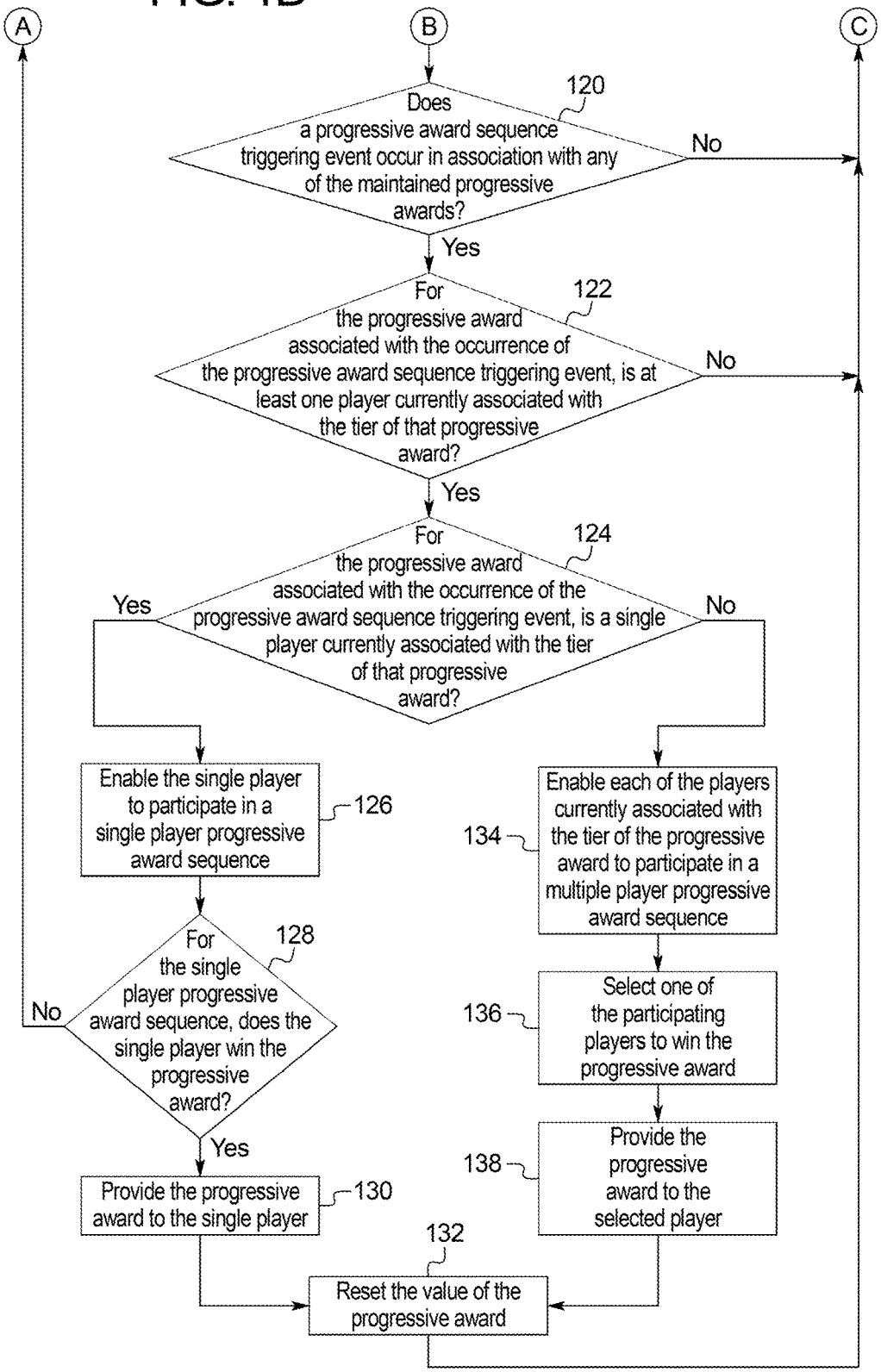

FIG. 1 is a flowchart of an example process or method of operating the gaming system of the present disclosure. In various embodiments, the process is represented by a set of instructions stored in one or more memories and executed by one or more processors. Although the process is described with reference to the flowchart shown in FIG. 1, many other processes of performing the acts associated with this illustrated process may be employed. For example, the order of certain of the illustrated blocks or diamonds may be changed, certain of the illustrated blocks or diamonds may be optional, or certain of the illustrated blocks or diamonds may not be employed.

In various embodiments, the gaming system maintains a plurality of progressive awards in a plurality of tiers, levels or stages as indicated by block 102.

In one embodiment, the gaming system associates a different progressive award with each different tier, level or stage. For example, as seen in FIG. 2, the gaming system maintains five separate progressive awards 202*a*, 202*b*, 202*c*, 202*d* and 202*e* which are associated with tiers 204*a*, 204*b*, 204*c*, 204*c* and 204*e*, respectively. In certain embodiments, the gaming system associates a plurality of progressive awards with each different tier, level or stage. In one embodiment, one or more progressive awards are each associated with a separate tier, level or stage. In another embodiment, one or more progressive awards are each associated with a plurality of separate tiers, levels or stages.

In addition to being associated with one or more progressive awards, each tier, level or stage is associated with one or more skill-based games. For example, as seen in FIG. 2, tier 204*a* is associated with skill-based games 206*a* and 206*b*, tier 204*b* is associated with skill-based games 206*c* and 206*d*, tier 204*c* is associated with skill-based games 206*e*, 206*f*, and 206*g*, tier 204*d* is associated with skill-based games 206*h*, 206*i*, and 206*j*, and tier 204*e* is associated with skill-based games 206*k*, 206*l*, 206*m*, and 206*n*, In different embodiments, for one or more tiers, the skill-based game includes, but is not limited to: a matching game, an action game, a shooter game, a first person shooter game, an action-adventure game, a construction and management simulation game, a life simulation game, a role playing game, a multiplayer role playing game, a strategy game, a vehicle simulation game, a music game, a party game, a puzzle game, a sports game, a board game, a card game, a word game, a Mahjong game, a 3-in-a-row game, a hidden object game, an educational game, an arcade-style game, a pinball game, a trivia game, a domino game and/or any other suitable type of game. In such embodiments, skill includes, but is not limited to: (i) physical skill, such as, but not limited to: timing, aim, physical strength or any combination thereof which is quantifiable by one or more inputs made by the player (or the lack of any inputs made by the player) in association with the skill-based game; (ii) mental skill (i.e., knowledge, reasoning, and/or strategy) which is quantifiable by one or more inputs made by the player (or the lack of any inputs made by the player) in association with the skill-based game; and (iii) any other type of skill which is quantifiable by one or more inputs made by the player (or the lack of any inputs made by the player) in association with the skill-based game.

In one embodiment, the level of skill required for success in the play of a skill-based game is the same for each of the skill-based games of each tier, level or stage. In another embodiment, the level of skill required for success in the play of a skill-based game is different for the skill-based games of two or more tiers, levels or stages. In another embodiment, the level of skill required for success in the play of a skill-based game is different for the skill-based games of each tier, level or stage. For example, as a player advances, from one tier of skill-based games to another tier of skill-based games, the level of skill required for success in the play of the skill-based game(s) of the advanced to tier increases.

In one embodiment, the level of skill required for success in the play of a skill-based game is the same for each of the skill-based games of a tier, level or stage. In another embodiment, the level of skill required for success in the play of a skill-based game is different for two or more of the skill-based games of a tier, level or stage. In another embodiment, the level of skill required for success in the play of a skill-based game is different for the skill-based game of a tier, level or stage. For example, as a player advances, from one skill-based game to another skill-based game within the same tier of skill-based games, the level of skill required for success in the play of the advanced to skill-based game of the same tier increases.

In different embodiments, upon an occurrence of a skill-based game triggering event, as indicated by block 104 of FIG. 1, the gaming system determines, based on a current tier, which of a plurality of skill-based games to trigger.

In one embodiment, the gaming system tracks a player's progress through the different skill-based games of the different tiers in association with a current gaming session. In this embodiment, each time the skill-based game triggering event occurs, the gaming system determines the player's currently achieved skill-based game (i.e., the skill-based game following the last successfully completed skill-based game) associated with the current gaming session. In one such embodiment, the gaming system then triggers the player's currently achieved skill-based game. In another such embodiment, the gaming system triggers a default skill-based game of the same tier as the tier of the player's currently achieved skill-based game.

In another embodiment, the gaming system tracks a player's progress through the different skill-based games of the different tiers in association with one or more gaming sessions. In these embodiments, to facilitate a persistence aspect to the gaming system by tracking and storing a player's advancement amongst the skill-based games of one or more tiers, the gaming system stores a player's progress through the different skill-based games of the different tiers in association with a player account. In one such embodiment, the gaming system stores the player's progress through the different skill-based games of the different tiers in association with a player tracking system. In this embodiment, upon the player logging into the player tracking system, such as when the player inserts their player tracking card or otherwise identifies themselves, the gaming system determines the player's current tier and/or current skill-based game within the current tier. In one such embodiment, the gaming system determines to initiate a default skill-based game of a stored current tier, level or stage associated with a player. In another such embodiment, the gaming system determines to initiate a currently played (i.e., last advanced to) skill-based game of stored a current tier, level or stage associated with a player. It should be appreciated that any suitable system to store a player's progress amongst the skill-based games of one or more tiers may be implemented in association with the present disclosure.

In one embodiment, the gaming system tracks the progress of an electronic gaming machine ("EGM") through the different skill-based games of the different tiers in association with a current gaming session. In this embodiment, each time the skill-based game triggering event occurs, the gaming system determines the EGM's currently achieved skill-based game (i.e., the skill-based game following the last successfully completed skill-based game) associated with the current gaming session. In one such embodiment, the gaming system then triggers the EGM's currently achieved skill-based game. In another such embodiment, the gaming system triggers a default skill-based game of the same tier as the tier of the EGM's currently achieved skill-based game.

In another embodiment, the gaming system determines to initiate a default skill-based game upon an occurrence of a skill-based game triggering event. In one such embodiment, each time the skill-based game triggering event occurs, the gaming system triggers an initial skill-based game of an initial level. It should be appreciated that these embodiments lack a persistence aspect between skill-based game triggering events by requiring a player to advance through (i.e., replay previously completed skill-based games) one or more lower-level tiers each time the skill-based game triggering event occurs.

Following the selection of which of a plurality of skill-based games to trigger, the gaming system initiates or triggers a play of the selected skill-based game as indicated in block 106. In one embodiment, the selected skill-based game (or the selected partial skill-based game) is a primary game wherein a skill-based game triggering event occurs upon a player placing a wager to play a skill-based game. In one such embodiment, a portion of each wager placed to play a skill-based game is allocated to one or more of the maintained progressive awards. In another such embodiment, a portion of certain wagers placed to play a skill-based game, such as a portion of any designated wagers placed, is allocated to one or more of the maintained progressive awards. In certain embodiments, the portion of the wager placed is allocated to each of the maintained progressive awards. In certain embodiments, the portion of the wager placed is allocated to the maintained progressive award associated with the same tier as the selected skill-based game. It should be appreciated that the gaming system can allocate the same or different portions of each wager to one or more of the progressive awards.

In another embodiment, the selected skill-based game (or the selected partial skill-based game) is a secondary or bonus game wherein a skill-based game triggering event occurs based on a displayed event associated with a wagered on play of a primary game. In another embodiment wherein the selected skill-based game (or the selected partial skill-based game) is a secondary or bonus game, a skill-based game triggering event occurs based on an event independent of any displayed event associated with a wagered on play of a primary game. In these embodiments, a portion of each wager placed to play a primary game is allocated to one or more of the maintained progressive awards. In another such embodiment, a portion of certain wagers placed to play a primary game, such as a portion of any designated wagers placed, is allocated to one or more of the maintained progressive awards.

In one embodiment, as indicated by block 108 of FIG. 1, after an initiation of the triggered skill-based game, the gaming system enables the player to make one or more quantifiable skill inputs in association with the play of the triggered skill-based game. As mentioned above, a player's skill is determined and quantified by one or more inputs (or the lack of any inputs) by the player. These determined and quantified inputs tend to measure one or more aspects of the player's skill.

In various embodiments, the player utilizes one or more skill input devices to make one or more quantifiable skill inputs. Examples of skill input devices include, but are not limited to: joysticks, buttons, a mouse or a plurality of mice, one or more trackballs, one or more pointing devices, one or more bodily motion trackers such as motion sensing devices for human-computer interaction, touchpads, touchscreens, one or more controllers with: (1) one or more motion sensing devices, (2) one or more proximity sensing devices, (3) one or more force sensing devices (transducers), (4) one or more accelerometers, or any other suitable skill input devices.

By making one or more quantifiable skill inputs, the player manipulates, influences or otherwise controls one or more aspects of the skill-based game (and thus influences or otherwise affects the outcome of the skill-based game). In certain embodiments, different quantifiable skill inputs by the player influence a different event or a different sequence of events which occur in association with the play of the skill-based game. That is, a first quantifiable skill input (or type of quantifiable skill input) by the player results in a first outcome, a first series of outcomes, a first event or a first sequence of events, while a second different quantifiable skill input (or type of quantifiable skill input) by the player results in a second outcome, a second series of outcomes, a second event or a second sequence of events.

In certain embodiment, the gaming system determines if a skill-based game outcome determination event has occurred, as indicated by diamond 110. In one embodiment, a skill-based game outcome determination event occurs based on time. For example, the gaming system determines a designated amount of time for the player to play (or otherwise complete) a skill-based game and a skill-based game outcome determination event occurs when the designated amount of time elapses (or otherwise expires). In another embodiment, the gaming system determines a designated number of quantifiable skill inputs and a skill-based game outcome determination event occurs when a player utilizes the designated number of quantifiable skill inputs. For example, the gaming system determines that a player is enabled to make ten quantifiable skill inputs to select matching symbols to be removed and accumulated. When the player makes the tenth quantifiable skill input to select matching symbols to be removed and accumulated, the skill-based game outcome determination event occurs. In another embodiment, the gaming system determines a designated number of quantifiable skill inputs and a skill-based game outcome determination event occurs when the player achieves a displayed goal associated with the play of the skill-based game or otherwise utilizes the designated number of quantifiable skill inputs. For example, the gaming system determines that a player is enabled to make ten quantifiable skill inputs to select matching symbols to be removed and accumulated with the goal of accumulated twenty of a designated symbol. In this example, the skill-based game outcome determination event occurs upon the first of the player accumulating at least twenty of the designated symbol or the player making the tenth quantifiable skill input (to select matching symbols to be removed and accumulated) without accumulating twenty of the designated symbols. It should be appreciated that the skill-based game outcome determination event may occur based on any other suitable event, method or criteria.

In one embodiment, if a skill-based game outcome determination event has not occurred, the gaming system returns to block 108 and continues enabling the player to make one or more quantifiable skill inputs. On the other hand, as indicated by block 112, if a skill-based game outcome determination event has occurred in association with the play of the skill-based game, the gaming system determines a skill-based game outcome based, at least in part, on one or more of the quantifiable skill inputs made by the player. After determining the outcome for the skill-based game, the gaming system determines and displays an award associated with the determined outcome as indicated by block 114.

In certain embodiments, following the display of an award associated with the determined outcome, the gaming system determines if the player has advanced to beyond the skill-based game currently played as indicated in diamond 116. That is, the gaming system determines, based on the level of skill exhibited by the player, whether or not the player advances to another skill-based game for the player's current tier (or advances to another skill-based game for a different, higher tier). Put differently, in these embodiments, the outcome of the play of the skill-based game determines whether the player remains in the same tier (and would play the same skill-based game upon another occurrence of the skill-based game triggering event) or advances in the hierarchy of tiered skill-based games. As such, since different tiers are associated with different progressive awards and since the player advances from one tier to another tier based on the player's level of skill exhibited during the plays of such skill-based games, the gaming system includes a player advancing from eligibility to win one progressive award to eligibility to win another progressive award based on the player's level of skill exhibited during the plays of such skill-based games. The gaming system of these embodiments thus determines if a player qualifies to potentially win one or more progressive awards, as described below, based on that player's level of skill and specifically based on that player's level of skill demonstrated across multiple plays of multiple skill-based games of differing tiers.

In one such embodiment, the gaming system determines if the player advances based on the award associated with the determined outcome being at or above an advancement threshold for the played skill-based game. In this embodiment, if the award associated with the determined outcome is below an advancement threshold for the played skill-based game, the gaming system does not advance the player to another skill-based game. On the other hand, if the award associated with the determined outcome is at or above an advancement threshold for the played skill-based game, the gaming system advances the player to the next skill-based game for the current tier (or the first skill-based game for the next available tier).

In one embodiment, if a player advances from one tier to another tier to qualify to potentially win the progressive award associated with the advanced to tier, the gaming system remains qualified to potentially win the progressive award associated with the advanced from tier. In this embodiment, as the player advances tiers based on their ability in the plays of the skill-based games, the player becomes eligible to win more and more progressive awards. This embodiment provides an incentive for players to continue to advance to higher and higher tiers without the risk of losing eligibility to win any progressive awards associated with any lower tiers. In another embodiment, if a player advances from one tier to another tier to qualify to potentially win the progressive award associated with the advanced to tier, the gaming system forfeits being qualified to potentially win the progressive award associated with the advanced from tier.

If the gaming system determines, based on the level of skill exhibited by the player, that the player does not advance to another skill-based game for the player's current tier (or advanced to another skill-based game for a different, higher tier), the gaming system returns to block 104 and await another occurrence of a skill-based game triggering event. In this embodiment, upon another occurrence of the skill-based game triggering event, the gaming system will select the same skill-based game (i.e., the skill-based game which the player did not advance from) to play again.

On the other hand, if the gaming system determines, based on the level of skill exhibited by the player, that the player advanced to another skill-based game for the player's current tier (or advanced to another skill-based game for a different, higher tier), as indicated in block 118, the gaming system triggers a play of the advanced to skill-based game and returns to block 108 to enable the player to make one or more quantifiable skill inputs in association with the play of the triggered advanced to skill-based game. In this embodiment, the gaming system rewards a player's advancement from one skill-based game to another skill-based game with at least one play of the advanced to skill-based game, wherein the player continues advancing to additional skill-based games based on the level of skill demonstrated in the plays of such skill-based games.

In another embodiment, if the gaming system determines, based on the level of skill exhibited by the player, that the player advanced to another skill-based game for the player's current tier (or advanced to another skill-based game for a different, higher tier), the gaming system does not trigger a play of the advanced to skill-based game. Rather, in this embodiment, even if a player advances to another skill-based game, the player must wait for another occurrence of the skill-based game triggering event to play the advanced to skill-based game.

Accordingly, for the plays of the skill-based games of the hierarchy or configuration of different tiers, levels or stages of skill-based games, the player's level of skill (as determined based on or quantified by zero, one or more inputs made by the player which tend to measure one or more aspects of that player's skill) determine the outcomes of such plays of the skill-based games and further determine whether the player remains in the same tier, level or stage or advances to another tier, level or stage.

In addition to utilizing a player's level of skill to determine one or more skill-based game outcomes and one or more tiers associated with the player (and thus one or more progressive awards which the player is eligible to win), following the occurrence of a skill-based game triggering event, the gaming system disclosed herein also determines if a progressive award sequence triggering event occurs in association with any of the maintained progressive awards as indicated in diamond 120.

In one embodiment, the gaming system determines if a progressive award sequence triggering event occurs in association with each occurrence of the skill-based game triggering event. In one such embodiment wherein the skill-based game triggering event occurs upon a player placing a wager on a play of a primary skill-based game, for each wager placed, the gaming system determines if a progressive award sequence triggering event occurs. In certain embodiments, the greater the wager amount placed, the greater the probability of the gaming system determining that a progressive award sequence triggering event occurs.

In another embodiment, a progressive award sequence triggering event occurs based on a displayed event associated with a play of a game, such as the skill-based game. In another embodiment, a progressive award sequence triggering event occurs based on an event independent of any displayed event associated with any play of any game.

It should be appreciated that while FIG. 1 illustrates the determination of if a progressive award sequence triggering event occurs following an occurrence of a skill-based game triggering event, the determination of if a progressive award sequence triggering event occurs may be independent of any occurrence of any skill-based game triggering event. For example, if a skill-based game is implemented as a secondary game and if a progressive award sequence triggering event occurs based on one of the maintained progressive awards incrementing to a designated value upon the placement of a wager, the progressive award sequence triggering event may occur without any occurrence of a skill-based game triggering event.

If the gaming system determines that no progressive award sequence triggering event occurs in association with any of the maintained progressive awards, the gaming system returns to block 104 and await another occurrence of a skill-based game triggering event. In this embodiment, upon another occurrence of the skill-based game triggering event, the gaming system will again determine if a progressive award sequence triggering event occurs.

On the other hand, if the gaming system determines that a progressive award sequence triggering event occurs in association with one of the maintained progressive awards, for the progressive award associated with the occurrence of the progressive award sequence triggering event, the gaming system determines, as indicated in diamond 122, if at least one player is currently associated with the tier of that progressive award.

In one embodiment, the determination of if at least one player is currently associated with the tier of that progressive award includes determining if any players are currently associated with the tier of that progressive award or any lower tiers. In this embodiment, if a player has advanced past a tier and a progressive award sequence triggering event subsequently occurs in association with that former tier, for eligibility determination purposes, the gaming system still considers that player as being associated with the tier of that progressive award. Such an embodiment provides an additional benefit to the player in the form of not penalizing the player for their past success in advancing past any specific tier. In another embodiment, the determination of if at least one player is currently associated with the tier of that progressive award includes determining if any players are currently associated with the tier of that progressive award. In this embodiment, upon an occurrence of a progressive award sequence triggering event for a progressive award of a particular tier, the gaming system determines if any players are currently slotted in the particular tier and thus if any players are currently eligible to win or try to win the progressive award.

If the gaming system determines that no players are currently associated with the tier of the progressive award associated with the occurrence of the progressive award sequence triggering event, the gaming system returns to block 104 and await another occurrence of a skill-based game triggering event. In this embodiment, upon another occurrence of the skill-based game triggering event, the gaming system will again determine if a progressive award sequence triggering event occurs. Accordingly, if no players have exhibited the requisite amount of player skill during the plays of the skill-based games to advance at least to the tier, of the progressive award associated with the occurrence of the progressive award sequence triggering event, the gaming system does not provide the progressive award to any unqualified players.

On the other hand, if the gaming system determines that at least one player is currently associated with the tier of the progressive award associated with the occurrence of the progressive award sequence triggering event, the gaming system determines, as indicated in diamond 124, if a single player is currently associated with the tier of that progressive award.

If a single player is currently associated with the tier of the progressive award associated with the occurrence of the progressive award sequence triggering event, as indicated in block 126, the gaming system enables the player to participate in a single player progressive award sequence. For the single player progressive award sequence, the gaming system determines, as indicated in diamond 128, whether the player wins the progressive award. As such, if one player has exhibited the requisite amount of player skill during the plays of the skill-based games to advance at least to the tier of the progressive award associated with the occurrence of the progressive award sequence triggering event, the gaming system enables the player to exhibit a further amount of player skill during the progressive award sequence to potentially be provided the progressive award.

In one embodiment, the single player progressive award sequence includes one or more plays of one or more skill-based games (or partial skill-based games) as disclosed herein. In these embodiment, the single player progressive award sequence includes enabling the player to play one or more skill-based games (or partial skill-based game) to determine whether or not to provide the progressive award to that player. In such embodiments, the player's inputs (which tend to measure one or more aspects of that player's skill result) made during the plays of the skill-based games (or partial skill-based game) of the triggered single player progressive award sequence result in either the gaming system providing the progressive award to the player or not providing the progressive award to the player in association with that occurrence of the progressive award sequence triggering event. That is, the gaming system enables a single player to participate in the single player progressive award sequence with the goal of demonstrating at least the amount of skill necessary to win a progressive award. As such, if one player has exhibited the requisite amount of player skill during the plays of the skill-based games to advance at least to the tier of the progressive award associated with the occurrence of the progressive award sequence triggering event, the gaming system enables the player to exhibit a further amount of player skill during the single player progressive award sequence to potentially be provided the progressive award.

In one such embodiment, the skill-based game(s) utilized for the single player progressive award sequence are the same as the skill-based game(s) utilized upon an occurrence of a skill-based game triggering event. In this embodiment, the current tier associated with the player determines both the skill-based game to be triggered upon an occurrence of a skill-based game triggering event and the skill-based game to be triggered upon a progressive award sequence triggering event. In another such embodiment, the skill-based game(s) utilized for the single player progressive award sequence are different from the skill-based game(s) utilized upon an occurrence of a skill-based game triggering event. In this embodiment, the current tier associated with the player determines the skill-based game to be triggered upon an occurrence of a skill-based game triggering event and may or may not determine the skill-based game to be triggered upon a progressive award sequence triggering event.

In one embodiment, the gaming system determines whether to provide the progressive award to the player in association with the single player progressive award sequence based, at least in part, on the wagering history of the player. In these embodiments, the gaming system utilizes the player's wagering history to influence one or more outcomes of the single player progressive award sequence wherein the greater the player's wagering history, the greater the probability of success in the single player progressive award sequence. In one such embodiment wherein the single player progressive award sequence is a skill-based game (or partial skill-based game), the gaming system modifies one or more aspects of the game based on the player's wagering history. For example, the greater the player's relative wagering history, the larger, on average, the size of the targets for the player to shoot at in a single player progressive award shooting sequence. In another example, the greater the player's relative wagering history, the more lucrative the paytable utilized in a single player progressive award sequence.

If the gaming system determines that the player wins the progressive award in association with the single player progressive award sequence, the gaming system provides the progressive award to the player and resets the value of the progressive award as indicated in blocks 130 and 132, respectively.

Following resetting the value of the progressive award or upon a determination that the player does not win the progressive award in association with the single player progressive award sequence, the gaming system returns to block 104 and await another occurrence of a skill-based game triggering event. In this embodiment, upon another occurrence of the skill-based game triggering event, the gaming system will again determine if a progressive award sequence triggering event occurs.

On the other hand, if more than a single player is currently associated with the tier of the progressive award associated with the occurrence of the progressive award sequence triggering event, as indicated in block 134, the gaming system enables each of the players currently associated with the tier of the progressive award to participate in a multiple player progressive award sequence. For the multiple player progressive award sequence, as indicated in block 136, the gaming system selects one of the participating players to win the progressive award.

In certain embodiments, the multiple player progressive award sequence includes one or more plays of one or more skill-based games as disclosed herein. In certain embodiments, the multiple player progressive award sequence includes one or more plays of one or more partial skill-based games as disclosed herein, wherein a player's level of skill is a factor, but not necessarily the deciding factor, in if that player wins a progressive award. In these embodiments, the multiple player progressive award sequence for the qualifying players includes enabling each of the players to play one or more skill-based games (or partial skill-based games) which determine whether or not that player will be provided the progressive award.

In certain embodiments, the multiple player progressive award sequence is displayed to the qualifying players as tournament. In these embodiments, for each qualifying player, at least partially based on that player's inputs (which tend to measure one or more aspects of that player's skill result) made during the plays of the skill-based games (or partial skill-based games) of the triggered multiple player progressive award sequence, the gaming system determines a relative ranking or position for that player. In these embodiments, a player's relative ranking is based on a on a quantity of points provided to the player as a result of the player's measured skill during the plays of the skill-based game of the triggered multiple player progressive award sequence. During the play of the multiple player progressive award sequence, the gaming system displays the player's relative ranking, current quantity of points and the relative ranking and current quantity of points for one or more other players via a leader board. Following the plays of the games of the triggered multiple player progressive award event and the gaming system displaying a tournament summary including the final score or final position for one or more qualifying players, the gaming system determines which of the qualifying players wins the progressive award based at least in part on each player's determined ranking or position.

Accordingly, if a plurality of players each exhibited the requisite amount of player skill during the plays of the skill-based games to advance at least to the tier of the progressive award associated with the occurrence of the progressive award sequence triggering event, the gaming system enables these players to each exhibit a further amount of player skill during the multiple player progressive award sequence, such as a further amount of skill during a skill-based tournament, to determine which one of these qualifying players will be provided the progressive award.

In one such embodiment, the skill-based game(s) utilized for the multiple player progressive award sequence are the same as the skill-based game(s) utilized upon an occurrence of a skill-based game triggering event. In this embodiment, the current tier associated with one or more players determines both the skill-based game to be triggered upon an occurrence of a skill-based game triggering event and the skill-based game to be triggered upon a progressive award sequence triggering event. In another such embodiment, the skill-based game(s) utilized for the multiple player progressive award sequence are different from the skill-based game(s) utilized upon an occurrence of a skill-based game triggering event. In this embodiment, the current tier associated with one or more players determines the skill-based game to be triggered upon an occurrence of a skill-based game triggering event and may or may not determine the skill-based game to be triggered upon a progressive award sequence triggering event.

In one embodiment, the gaming system determines whether to provide the progressive award to the player in association with the multiple player progressive award sequence based, at least in part, on the wagering history of one or more players. In these embodiments, the gaming system utilizes one or more player's respective wagering history to influence one or more outcomes of the multiple player progressive award sequence wherein the greater a player's wagering history, the greater the probability of that player being selected to win the progressive award in the multiple player progressive award sequence. In one such embodiment wherein the multiple player progressive award sequence is a skill-based game (or partial skill-based game), the gaming system modifies one or more aspects of the game based on one or more player's respective wagering history. For example, the greater the player's relative wagering history, the larger, on average, the more lucrative the objects which that player may accumulate in a multiple player progressive award racing sequence. In another example, the greater the player's relative wagering history, the more frequently, on average, the gaming system will provide a random tournament score to the player in association with the skill-based tournament of the multiple player progressive award sequence.

Following the selection of one of the participating players to win the progressive award in association with the multiple player progressive award sequence, the gaming system provides the progressive award to the selected player and resets the value of the progressive award as indicated in blocks 138 and 132, respectively. Following resetting the value of the progressive award, the gaming system returns to block 104 and await another occurrence of a skill-based game triggering event. In this embodiment, upon another occurrence of the skill-based game triggering event, the gaming system will again determine if a progressive award sequence triggering event occurs.

Accordingly, the gaming system disclosed herein: (i) determines whether a player is eligible to win one of a plurality of progressive awards based on zero, one or more inputs made by the player in one or more plays of one or more skill-based games, and (ii) subsequently determines whether to provide the progressive award that the player is currently eligible to win to that player based on zero, one or more inputs made the player in a skill-based progressive award sequence. Put differently, the gaming system disclosed herein first determines whether a player is eligible to win at least one of a plurality of progressive awards based on that player's level of skill (as determined based on zero, one or more skill measurable inputs made by the player over one or more plays of one or more skill-based games associated with one or more tiers, levels or stages). After determining the player's eligibility to win one of the progressive awards, upon the subsequent occurrence of a progressive award sequence triggering event, the gaming system determines whether or not the player wins that progressive award based on that player's level of skill (as determined based on zero, one or more skill measurable inputs made by the player over one or more plays of one or more skill-based games in association with a progressive award sequence). Such a configuration thus incorporates one or more aspects of skill in determining which awards, such as progressive awards, are provided to players.

It should be appreciated that while the play of one or more games or progressive award sequences disclosed herein are described as being a skill-based game, a partial skill-based game, a progressive award sequence which utilizes a skill-based game or a progressive award sequence which utilizes a partial skill-based game, in different embodiments, such games or progressive award sequences may additionally or alternatively includes, but not be limited to:

i. a play of any suitable slot game;
ii. a play of any suitable wheel game;
iii. a play of any suitable card game;
iv. a play of any suitable offer and acceptance game;
v. a play of any suitable award ladder game;
vi. a play of any suitable puzzle-type game;
vii. a play of any suitable persistence game;
viii. a play of any suitable selection game;
ix. a play of any suitable cascading symbols game;
x. a play of any suitable ways to win game;
xi. a play of any suitable scatter pay game;
xii. a play of any suitable coin-pusher game;
xiii. a play of any suitable elimination game;
xiv. a play of any suitable stacked wilds game;
xv. a play of any suitable trail game;
xvi. a play of any suitable bingo game;
xvii. a play of any suitable video scratch-off game;
xviii. a play of any suitable pick-until-complete game;
xix. a play of any suitable shooting simulation game;
xx. a play of any suitable racing game;
xxi. a play of any suitable promotional game;
xxii. a play of any suitable high-low game;
xxiii. a play of any suitable lottery game;
xxiv. a play of any suitable number selection game;
xxv. a play of any suitable dice game;
xxvi. a play of any suitable auction game;
xxvii. a play of any suitable reverse-auction game;
xxviii. a play of any suitable group game;
xxix. a play of any suitable game in a service window;
xxx. a play of any suitable game on a mobile device; and/or
xxxi. a play of any suitable game disclosed herein.

In various embodiments, as described above, the gaming system maintains a plurality of progressive awards in association with a plurality of different tiers. In certain embodiments, the gaming system maintains the plurality of progressive awards associated with the tiers in a multi-level progressive award configuration ("MLP"). In one such embodiment, the MLP includes a plurality of progressive award levels associated with the plurality of tiers wherein for each one of the progressive award levels of the MLP, the gaming system associates one or more of the maintained progressive awards with that progressive award level of the MLP.

In one embodiment, a plurality of EGMs at one or more gaming sites may be networked to the central server in a progressive configuration, wherein a portion of each wager to initiate a base or primary game may be allocated to one or more progressive awards. In one embodiment, a progressive gaming system host site computer is coupled to a plurality of the central servers at a variety of mutually remote gaming sites for providing a multi-site linked progressive automated gaming system. In one embodiment, a progressive gaming system host site computer may serve EGMs distributed throughout a number of properties at different geographical locations including, for example, different locations within a city or different cities within a state.

In one embodiment, the progressive gaming system host site computer is maintained for the overall operation and control of the progressive gaming system. In this embodiment, a progressive gaming system host site computer oversees the entire progressive gaming system and is the master for computing all progressive jackpots. All participating gaming sites report to, and receive information from, the progressive gaming system host site computer. Each central server computer is responsible for all data communication between the gaming device hardware and software and the progressive gaming system host site computer. In one embodiment, an individual EGM may trigger a progressive award win. In another embodiment, a central server (or the progressive gaming system host site computer) determines when a progressive award win is triggered. In another embodiment, an individual EGM and a central controller (or progressive gaming system host site computer) work in conjunction with each other to determine when a progressive win is triggered, for example through an individual EGM meeting a predetermined requirement established by the central controller.

In one embodiment, at least two of the progressive awards are associated with different types of triggering events (e.g., triggering events based on coin-in or triggering events based on time). In another embodiment, at least two of the progressive awards are associated with different triggering events. In one such embodiment, a first progressive award is associated with a short term triggering event and a second progressive award is associated with a long term triggering event. The short term triggering event occurs more frequently than the long term triggering event. Thus, one or more of the progressive awards may be provided frequently (e.g., such as those with a low value) while another one or more of the progressive awards may be provided infrequently (e.g., such as those with a high value).

In one embodiment, one or more of the progressive awards are each funded via a side bet or side wager. In this embodiment, a player must place or wager a side bet to be eligible to win the progressive award associated with the side bet. In one embodiment, the player must place the maximum bet and the side bet to be eligible to win one of the progressive awards. In another embodiment, if the player places or wagers the required side bet, the player may wager at any credit amount during the primary game (i.e., the player need not place the maximum bet and the side bet to be eligible to win one of the progressive awards). In one such embodiment, the greater the player's wager (in addition to the placed side bet), the greater the odds or probability that the player will win one of the progressive awards. It should be appreciated that one or more of the progressive awards may each be funded, at least in part, based on the wagers placed on the primary games of the EGMs in the gaming system, via a gaming establishment or via any suitable manner.

In another embodiment, one or more of the progressive awards are partially funded via a side-bet or side-wager which the player may make (and which may be tracked via a side-bet meter). In one embodiment, one or more of the progressive awards are funded with only side-bets or side-wagers placed. In another embodiment, one or more of the progressive awards are funded based on player's wagers as described above as well as any side-bets or side-wagers placed.

In one alternative embodiment, a minimum wager level is required for an EGM to qualify to be selected to obtain one of the progressive awards. In one embodiment, this minimum wager level is the maximum wager level for the primary game in the EGM. In another embodiment, no minimum wager level is required for a EGM to qualify to be selected to obtain one of the progressive awards.

In one embodiment, different progressive awards associated with different tiers have different reset values. In another embodiment, at least two progressive awards associated with at least two different tiers have the same or similar reset value. In another embodiment, each of the progressive awards of each of the tiers have the same or similar reset value.

In certain embodiments, as described above, different skill-based games are associated with different tiers. In one embodiment, each tier, level or stage includes the same skill-based games. In another such embodiment, two or more tiers, levels or stages each includes one or more different skill-based games. In another such embodiment, each tier, level or stage includes one or more different skill-based games.

In one such embodiment, each tier, level or stage includes the same quantity of associated skill-based games. In another such embodiment, two or more tiers, levels or stages each includes the same quantity of associated skill-based games. In another such embodiment, two or more tiers, levels or stages each includes a different quantity of associated skill-based games. In another such embodiment, each tier, level or stage includes a different quantity of associated skill-based games.

In one embodiment, the gaming system weighs different inputs made during the play of the skill-based game differently. In this embodiment, certain inputs have a greater affect on the final skill-based game outcome than other inputs. For example, the first thirty seconds of a skill-based game (and/or the first eight inputs of the skill-based game) are associated with a first weighting and the final fifteen seconds of the skill-based game (and/or the final eight inputs of the skill-based game) are associated with a second, greater weighting. Such an embodiment increases the volatility of the skill-based game as the play of the skill-based game continues.

In different embodiments, one or more awards provided in association with one or more skill-based game plays, one or more non-skill-based primary game plays, and/or one or more non-skill-based secondary game plays include one or more of: a quantity of monetary credits, a quantity of non-monetary credits, a quantity of promotional credits, a quantity of player tracking points, a progressive award, a modifier, such as a multiplier, a quantity of free plays of one or more games, a quantity of plays of one or more secondary or bonus games, a multiplier of a quantity of free plays of a game, one or more lottery based awards, such as lottery or drawing tickets, a wager match for one or more plays of one or more games, an increase in the average expected payback percentage for one or more plays of one or more games, one or more comps, such as a free dinner, a free night's stay at a hotel, a high value product such as a free car, or a low value product, one or more bonus credits usable for online play, a lump sum of player tracking points or credits, a multiplier for player tracking points or credits, an increase in a membership or player tracking level, one or more coupons or promotions usable within and/or outside of the gaming establishment (e.g., a 20% off coupon for use at a convenience store), virtual goods associated with the gaming system, virtual goods not associated with the gaming system, an access code usable to unlock content on an internet.

In one embodiment, the gaming system causes at least one display device of an EGM to display the skill-based game and/or the progressive award sequence. In another embodiment, in addition or in alternative to each gaming device displaying the skill-based game and/or the progressive award sequence, the gaming system causes one or more community or overhead display devices to display part or all of the skill-based game and/or the progressive award sequence to one or more other players or bystanders either at a gaming establishment or viewing over a network, such as the internet. In another embodiment, in addition or in alternative to each EGM displaying the skill-based game and/or the progressive award sequence, the gaming system causes one or more internet sites to each display the skill-based game and/or the progressive award sequence such that a player is enabled to log on from a personal web browser. In another such embodiment, the gaming system enables the player to play one or more primary games on one device while viewing the skill-based game and/or the progressive award sequence from another device. For example, the gaming system enables the player to play one or more primary games on a mobile phone while viewing the status of the skill-based game and/or the progressive award sequence on a desktop or laptop computer.

In certain embodiments, a skill-based game triggering event and/or a progressive award sequence triggering event occurs based on an outcome associated with one or more plays of any primary games. In one embodiment, such determinations are symbol driven based on the generation of one or more designated symbols or symbol combinations. In various embodiments, a generation of a designated symbol (or sub-symbol) or a designated set of symbols (or sub-symbols) over one or more plays of a primary game causes such conditions to be satisfied and/or one or more of such events to occur. In another embodiment, such determinations are based on one or more aspects of skill demonstrated by one or more players. For example, a player exhibiting a level of skill above a threshold level of skill during the play of an initiated skill-based game causes an occurrence of a progressive award sequence triggering event.

In certain different embodiments, the gaming system does not provide any apparent reasons to the players for an occurrence of a skill-based game triggering event and/or a progressive award sequence triggering event. In these embodiments, such determinations are not triggered by an event in a game or based specifically on any of the plays of games. That is, these events occur without any explanation or alternatively with simple explanations.

In another such embodiment, a skill-based game triggering event and/or a progressive award sequence triggering event occurs based on an amount of coin-in. In this embodiment, the gaming system determines if an amount of coin-in reaches or exceeds a designated amount of coin-in (i.e., a threshold coin-in amount). Upon the amount of coin-in reaching or exceeding the threshold coin-in amount, the gaming system causes one or more of such events or conditions to occur. In one such embodiment, a skill-based game triggering event and/or a progressive award sequence triggering event occurs based on an amount of virtual currency-in. In this embodiment, the gaming system determines if an amount of virtual currency-in wagered reaches or exceeds a designated amount of virtual currency-in (i.e., a threshold virtual currency-in amount). Upon the amount of virtual currency-in wagered reaching or exceeding the threshold virtual currency-in amount, the gaming system causes one or more of such events or conditions to occur. In different embodiments, the threshold coin-in amount and/or the threshold virtual currency-in amount is predetermined, randomly determined, determined based on a player's status (such as determined through a player tracking system), determined based on a generated symbol or symbol combination, determined based on a random determination by the central controller, determined based on a random determination at the gaming device, determined based on one or more side wagers placed, determined based on the player's primary game wager, determined based on time (such as the time of day) or determined based on any other suitable method or criteria.

In another such embodiment, a skill-based game triggering event and/or a progressive award sequence triggering event occurs based on an amount of coin-out. In this embodiment, the gaming system determines if an amount of coin-out reaches or exceeds a designated amount of coin-out (i.e., a threshold coin-out amount). Upon the amount of coin-out reaching or exceeding the threshold coin-out amount, the gaming system causes one or more of such events or conditions to occur. In another such embodiment, a skill-based game triggering event and/or a progressive award sequence triggering event occurs based on an amount of virtual currency-out. In this embodiment, the gaming system determines if an amount of virtual currency-out reaches or exceeds a designated amount of virtual currency-out (i.e., a threshold virtual currency-out amount). Upon the amount of virtual currency-out reaching or exceeding the threshold virtual currency-out amount, the gaming system causes one or more of such events or conditions to occur. In different embodiments, the threshold coin-out amount and/or the threshold virtual currency-out amount is predetermined, randomly determined, determined based on a player's status (such as determined through a player tracking system), determined based on a generated symbol or symbol combination, determined based on a random determination by the central controller, determined based on a random determination at the gaming device, determined based on one or more side wagers placed, determined based on the player's primary game wager, determined based on time (such as the time of day) or determined based on any other suitable method or criteria.

In another embodiment, a skill-based game triggering event and/or a progressive award sequence triggering event occurs based on a predefined variable reaching a defined parameter threshold. For example, when the 500,000th player has played an electronic gaming machine (ascertained from a player tracking system), one or more of such events or conditions occur. In different embodiments, the predefined parameter thresholds include a length of time, a length of time after a certain dollar amount is hit, a wager level threshold for a specific device (which electronic gaming machine is the first to contribute $250,000), a number of electronic gaming machines active, or any other parameter that defines a suitable threshold.

In another embodiment, a skill-based game triggering event and/or a progressive award sequence triggering event occurs based on a quantity of games played. In this embodiment, a quantity of games played is set for when one or more of such events or conditions will occur. In one embodiment, such a set quantity of games played is based on historic data.

In another embodiment, a skill-based game triggering event and/or a progressive award sequence triggering event occurs based on time. In this embodiment, a time is set for when one or more of such events or conditions will occur. In one embodiment, such a set time is based on historic data.

In another embodiment, a skill-based game triggering event and/or a progressive award sequence triggering event occurs based upon gaming system operator defined player eligibility parameters stored on a player tracking system (such as via a player tracking card or other suitable manner). In this embodiment, the parameters for eligibility are defined by the gaming system operator based on any suitable criterion. In one embodiment, the gaming system recognizes the player's identification (via the player tracking system) when the player inserts or otherwise associates their player tracking card in the electronic gaming machine. The gaming system determines the player tracking level of the player and if the current player tracking level defined by the gaming system operator is eligible for one or more of such events or conditions. In one embodiment, the gaming system operator defines minimum bet levels required for such events or conditions to occur based on the player's card level.

In another embodiment, a skill-based game triggering event and/or a progressive award sequence triggering event occurs based on a system determination, including one or more random selections by the central controller. In one embodiment, as described above, the gaming system tracks all active electronic gaming machines and the wagers they placed. In one such embodiment, based on the electronic gaming machine's state as well as one or more wager pools associated with the electronic gaming machine, the gaming system determines whether to one or more of such events or conditions will occur. In one such embodiment, the player who consistently places a higher wager is more likely to be associated with an occurrence of one or more of such events or conditions than a player who consistently places a minimum wager. It should be appreciated that the criteria for determining whether a player is in active status or inactive status for determining if one or more of such events occur may the same as, substantially the same as, or different than the criteria for determining whether a player is in active status or inactive status for another one of such events to occur.

In another embodiment, a skill-based game triggering event and/or a progressive award sequence triggering event occurs based on a determination of if any numbers allotted to an electronic gaming machine match a randomly selected number. In this embodiment, upon or prior to each play of each electronic gaming machine, an electronic gaming machine selects a random number from a range of numbers and during each primary game, the electronic gaming machine allocates the first N numbers in the range, where N is the number of credits bet by the player in that primary game. At the end of the primary game, the randomly selected number is compared with the numbers allocated to the player and if a match occurs, one or more of such events or conditions occur. It should be appreciated that any suitable manner of causing a skill-based game triggering event and/or a progressive award sequence triggering event to occur may be implemented in accordance with the gaming system and method disclosed herein.

It should be appreciated that one or more of the above-described triggers pertaining to a skill-based game triggering event and/or a progressive award sequence triggering event occurring may be combined in one or more different embodiments.

It should be appreciated that in different embodiments, one or more of:

i. when a skill-based game triggering event and/or a progressive award sequence triggering event occurs;
ii. when a skill-based game and/or the progressive award sequence is initiated;
iii. what type of skill-based game and/or the progressive award sequence to initiate;
iv. whether to initiate a skill-based game or a partial-skill-based game for a play of a game and/or the progressive award sequence;
v. which type of skill to associate with the skill-based game and/or the progressive award sequence;
vi. which type of player skill inputs to enable one or more players to make for a play of a skill-based game and/or the progressive award sequence;
vii. a quantity of player skill inputs to enable one or more players to make for a play of a skill-based game and/or the progressive award sequence;
viii. a quantity of skill-based games to associate with one or more tiers;
ix. a quantity of progressive awards to maintain;
x. a quantity of progressive awards to associate with one or more tiers;
xi. when a skill-based game outcome determination event occurs;
xii. when to advance a player to another tier;
xiii. when to advance a player to a higher status within the same tier;
xiv. a quantity of players participating in a skill-based game;
xv. one or more amounts of time allotted for a play of a skill-based game and/or the progressive award sequence;
xvi. one or more awards provided in association with a play of a skill-based game and/or the progressive award sequence;
xvii. any event or trigger association with a skill-based game and/or the progressive award sequence; and
xviii. any determination disclosed herein;

is/are predetermined, randomly determined, randomly determined based on one or more weighted percentages, determined based on a generated symbol or symbol combination, determined independent of a generated symbol or symbol combination, determined based on a random determination by the central controller, determined independent of a random determination by the central controller, determined based on a random determination at the gaming system, determined independent of a random determination at the gaming system, determined based on at least one play of at least one game, determined independent of at least one play of at least one game, determined based on a player's selection, determined independent of a player's selection, determined based on one or more side wagers placed, determined independent of one or more side wagers placed, determined based on the player's primary game wager, determined independent of the player's primary game wager, determined based on time (such as the time of day), determined independent of time (such as the time of day), determined based on an amount of coin-in accumulated in one or more pools, determined independent of an amount of coin-in accumulated in one or more pools, determined based on a status of the player (i.e., a player tracking status), determined independent of a status of the player (i.e., a player tracking status), determined based on one or more other determinations disclosed herein, determined independent of any other determination disclosed herein or determined based on any other suitable method or criteria.

Gaming Systems

The above-described embodiments of the present disclosure may be implemented in accordance with or in conjunction with one or more of a variety of different types of gaming systems, such as, but not limited to, those described below.

The present disclosure contemplates a variety of different gaming systems each having one or more of a plurality of different features, attributes, or characteristics. A "gaming system" as used herein refers to various configurations of: (a) one or more central servers, central controllers, or remote hosts; (b) one or more electronic gaming machines such as those located on a casino floor; and/or (c) one or more personal gaming devices, such as desktop computers, laptop computers, tablet computers or computing devices, personal digital assistants, mobile phones, and other mobile computing devices.

Thus, in various embodiments, the gaming system of the present disclosure includes: (a) one or more electronic gaming machines in combination with one or more central servers, central controllers, or remote hosts; (b) one or more personal gaming devices in combination with one or more central servers, central controllers, or remote hosts; (c) one or more personal gaming devices in combination with one or more electronic gaming machines; (d) one or more personal gaming devices, one or more electronic gaming machines, and one or more central servers, central controllers, or remote hosts in combination with one another; (e) a single electronic gaming machine; (f) a plurality of electronic gaming machines in combination with one another; (g) a single personal gaming device; (h) a plurality of personal gaming devices in combination with one another; (i) a single central server, central controller, or remote host; and/or (j) a plurality of central servers, central controllers, or remote hosts in combination with one another.

For brevity and clarity and unless specifically stated otherwise, the term "EGM" is used herein to refer to an electronic gaming machine (such as a slot machine, a video poker machine, a video lottery terminal (VLT), a video keno machine, or a video bingo machine located on a casino floor). Additionally, for brevity and clarity and unless specifically stated otherwise, "EGM" as used herein represents one EGM or a plurality of EGMs, "personal computing device" as used herein represents one personal computing device or a plurality of personal computing devices, and "central server, central controller, or remote host" as used herein represents one central server, central controller, or remote host or a plurality of central servers, central controllers, or remote hosts.

Figure 3:
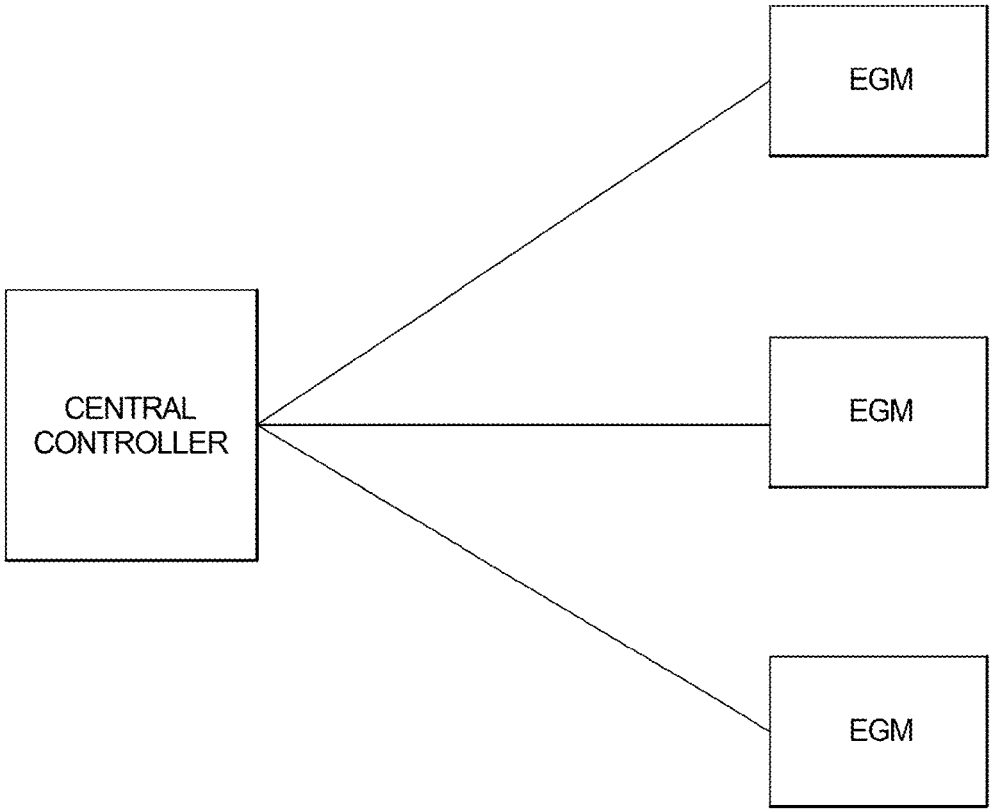
FIG. 3 is a schematic block diagram of one embodiment of a network configuration of the gaming system disclosed herein.

As noted above, in various embodiments, the gaming system includes an EGM (or personal computing device) in combination with a central server, central controller, or remote host. In such embodiments, the EGM (or personal computing device) is configured to communicate with the central server, central controller, or remote host through a data network or remote communication link. In certain such embodiments, the EGM (or personal computing device) is configured to communicate with another EGM (or personal computing device) through the same data network or remote communication link or through a different data network or remote communication link. For example, the gaming system illustrated in FIG. 3 includes a plurality of EGMs that are each configured to communicate with a central server, central controller, or remote host through a data network.

In certain embodiments in which the gaming system includes an EGM (or personal computing device) in combination with a central server, central controller, or remote host, the central server, central controller, or remote host is any suitable computing device (such as a server) that includes at least one processor and at least one memory device or data storage device. As further described herein, the EGM (or personal computing device) includes at least one EGM (or personal computing device) processor configured to transmit and receive data or signals representing events, messages, commands, or any other suitable information between the EGM (or personal computing device) and the central server, central controller, or remote host. The at least one processor of that EGM (or personal computing device) is configured to execute the events, messages, or commands represented by such data or signals in conjunction with the operation of the EGM (or personal computing device). Moreover, the at least one processor of the central server, central controller, or remote host is configured to transmit and receive data or signals representing events, messages, commands, or any other suitable information between the central server, central controller, or remote host and the EGM (or personal computing device). The at least one processor of the central server, central controller, or remote host is configured to execute the events, messages, or commands represented by such data or signals in conjunction with the operation of the central server, central controller, or remote host. One, more than one, or each of the functions of the central server, central controller, or remote host may be performed by the at least one processor of the EGM (or personal computing device). Further, one, more than one, or each of the functions of the at least one processor of the EGM (or personal computing device) may be performed by the at least one processor of the central server, central controller, or remote host.

In certain such embodiments, computerized instructions for controlling any games (such as any primary or base games and/or any secondary or bonus games) displayed by the EGM (or personal computing device) are executed by the central server, central controller, or remote host. In such "thin client" embodiments, the central server, central controller, or remote host remotely controls any games (or other suitable interfaces) displayed by the EGM (or personal computing device), and the EGM (or personal computing device) is utilized to display such games (or suitable interfaces) and to receive one or more inputs or commands. In other such embodiments, computerized instructions for controlling any games displayed by the EGM (or personal computing device) are communicated from the central server, central controller, or remote host to the EGM (or personal computing device) and are stored in at least one memory device of the EGM (or personal computing device). In such "thick client" embodiments, the at least one processor of the EGM (or personal computing device) executes the computerized instructions to control any games (or other suitable interfaces) displayed by the EGM (or personal computing device).

In various embodiments in which the gaming system includes a plurality of EGMs (or personal computing devices), one or more of the EGMs (or personal computing devices) are thin client EGMs (or personal computing devices) and one or more of the EGMs (or personal computing devices) are thick client EGMs (or personal computing devices). In other embodiments in which the gaming system includes one or more EGMs (or personal computing devices), certain functions of one or more of the EGMs (or personal computing devices) are implemented in a thin client environment, and certain other functions of one or more of the EGMs (or personal computing devices) are implemented in a thick client environment. In one such embodiment in which the gaming system includes an EGM (or personal computing device) and a central server, central controller, or remote host, computerized instructions for controlling any primary or base games displayed by the EGM (or personal computing device) are communicated from the central server, central controller, or remote host to the EGM (or personal computing device) in a thick client configuration, and computerized instructions for controlling any secondary or bonus games or other functions displayed by the EGM (or personal computing device) are executed by the central server, central controller, or remote host in a thin client configuration.

In certain embodiments in which the gaming system includes: (a) an EGM (or personal computing device) configured to communicate with a central server, central controller, or remote host through a data network; and/or (b) a plurality of EGMs (or personal computing devices) configured to communicate with one another through a data network, the data network is a local area network (LAN) in which the EGMs (or personal computing devices) are located substantially proximate to one another and/or the central server, central controller, or remote host. In one example, the EGMs (or personal computing devices) and the central server, central controller, or remote host are located in a gaming establishment or a portion of a gaming establishment.

In other embodiments in which the gaming system includes: (a) an EGM (or personal computing device) configured to communicate with a central server, central controller, or remote host through a data network; and/or (b) a plurality of EGMs (or personal computing devices) configured to communicate with one another through a data network, the data network is a wide area network (WAN) in which one or more of the EGMs (or personal computing devices) are not necessarily located substantially proximate to another one of the EGMs (or personal computing devices) and/or the central server, central controller, or remote host. For example, one or more of the EGMs (or personal computing devices) are located: (a) in an area of a gaming establishment different from an area of the gaming establishment in which the central server, central controller, or remote host is located; or (b) in a gaming establishment different from the gaming establishment in which the central server, central controller, or remote host is located. In another example, the central server, central controller, or remote host is not located within a gaming establishment in which the EGMs (or personal computing devices) are located. In certain embodiments in which the data network is a WAN, the gaming system includes a central server, central controller, or remote host and an EGM (or personal computing device) each located in a different gaming establishment in a same geographic area, such as a same city or a same state. Gaming systems in which the data network is a WAN are substantially identical to gaming systems in which the data network is a LAN, though the quantity of EGMs (or personal computing devices) in such gaming systems may vary relative to one another.

In further embodiments in which the gaming system includes: (a) an EGM (or personal computing device) configured to communicate with a central server, central controller, or remote host through a data network; and/or (b) a plurality of EGMs (or personal computing devices) configured to communicate with one another through a data network, the data network is an internet (such as the Internet) or an intranet. In certain such embodiments, an Internet browser of the EGM (or personal computing device) is usable to access an Internet game page from any location where an Internet connection is available. In one such embodiment, after the EGM (or personal computing device) accesses the Internet game page, the central server, central controller, or remote host identifies a player prior to enabling that player to place any wagers on any plays of any wagering games. In one example, the central server, central controller, or remote host identifies the player by requiring a player account of the player to be logged into via an input of a unique username and password combination assigned to the player. The central server, central controller, or remote host may, however, identify the player in any other suitable manner, such as by validating a player tracking identification number associated with the player; by reading a player tracking card or other smart card inserted into a card reader (as described below); by validating a unique player identification number associated with the player by the central server, central controller, or remote host; or by identifying the EGM (or personal computing device), such as by identifying the MAC address or the IP address of the Internet facilitator. In various embodiments, once the central server, central controller, or remote host identifies the player, the central server, central controller, or remote host enables placement of one or more wagers on one or more plays of one or more primary or base games and/or one or more secondary or bonus games, and displays those plays via the Internet browser of the EGM (or personal computing device). Examples of implementations of Internet-based gaming are further described in U.S. Pat. No. 8,764,566, entitled "Internet Remote Game Server," and U.S. Pat. No. 8,147,334, entitled "Universal Game Server," which are incorporated herein by reference.

The central server, central controller, or remote host and the EGM (or personal computing device) are configured to connect to the data network or remote communications link in any suitable manner. In various embodiments, such a connection is accomplished via: a conventional phone line or other data transmission line, a digital subscriber line (DSL), a T-1 line, a coaxial cable, a fiber optic cable, a wireless or wired routing device, a mobile communications network connection (such as a cellular network or mobile Internet network), or any other suitable medium. The expansion in the quantity of computing devices and the quantity and speed of Internet connections in recent years increases opportunities for players to use a variety of EGMs (or personal computing devices) to play games from an ever-increasing quantity of remote sites. Additionally, the enhanced bandwidth of digital wireless communications may render such technology suitable for some or all communications, particularly if such communications are encrypted. Higher data transmission speeds may be useful for enhancing the sophistication and response of the display and interaction with players.

EGM Components

Figure 4:
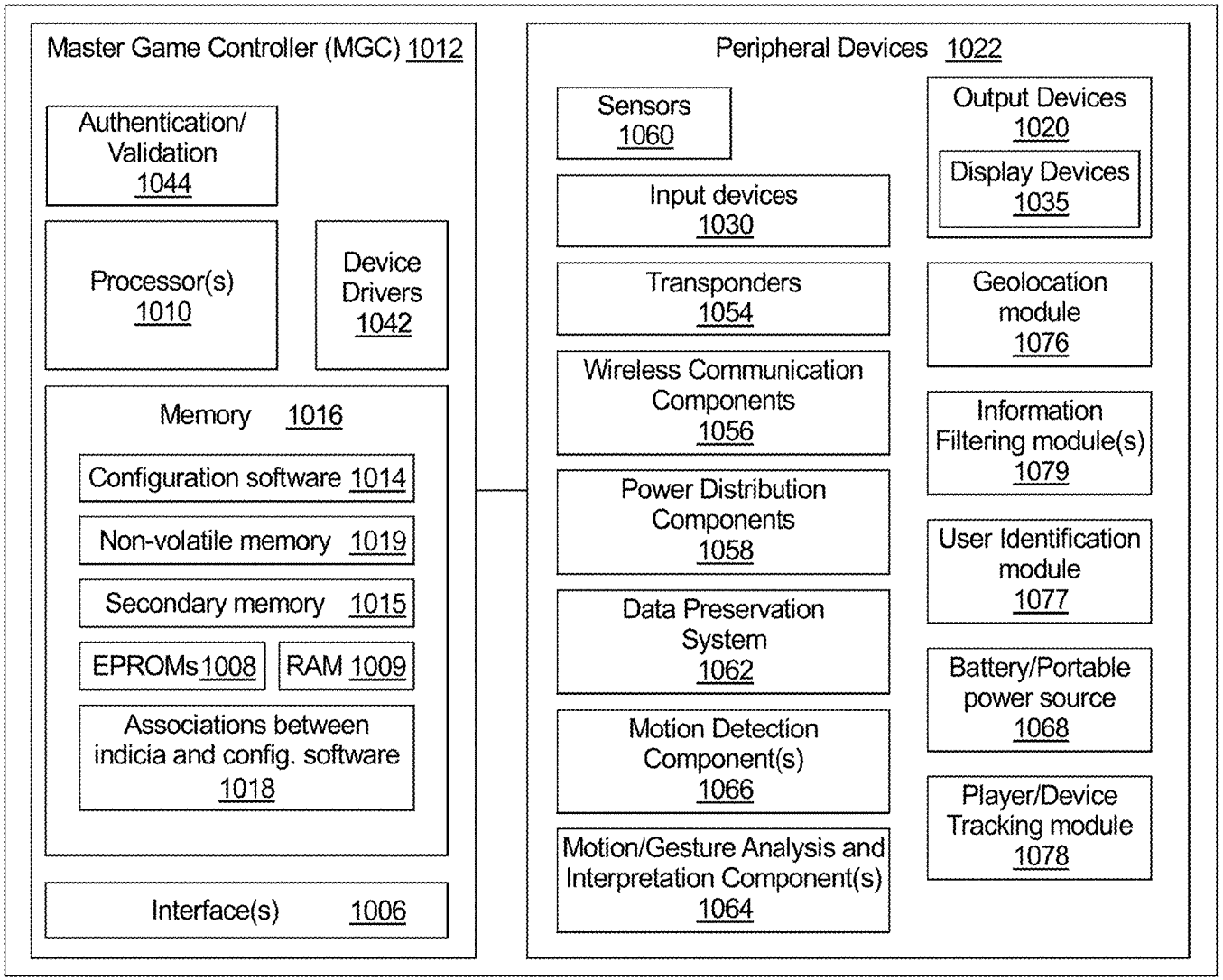
FIG. 4 is a schematic block diagram of one embodiment of an electronic configuration of an example gaming system disclosed herein.
Figure 5A:
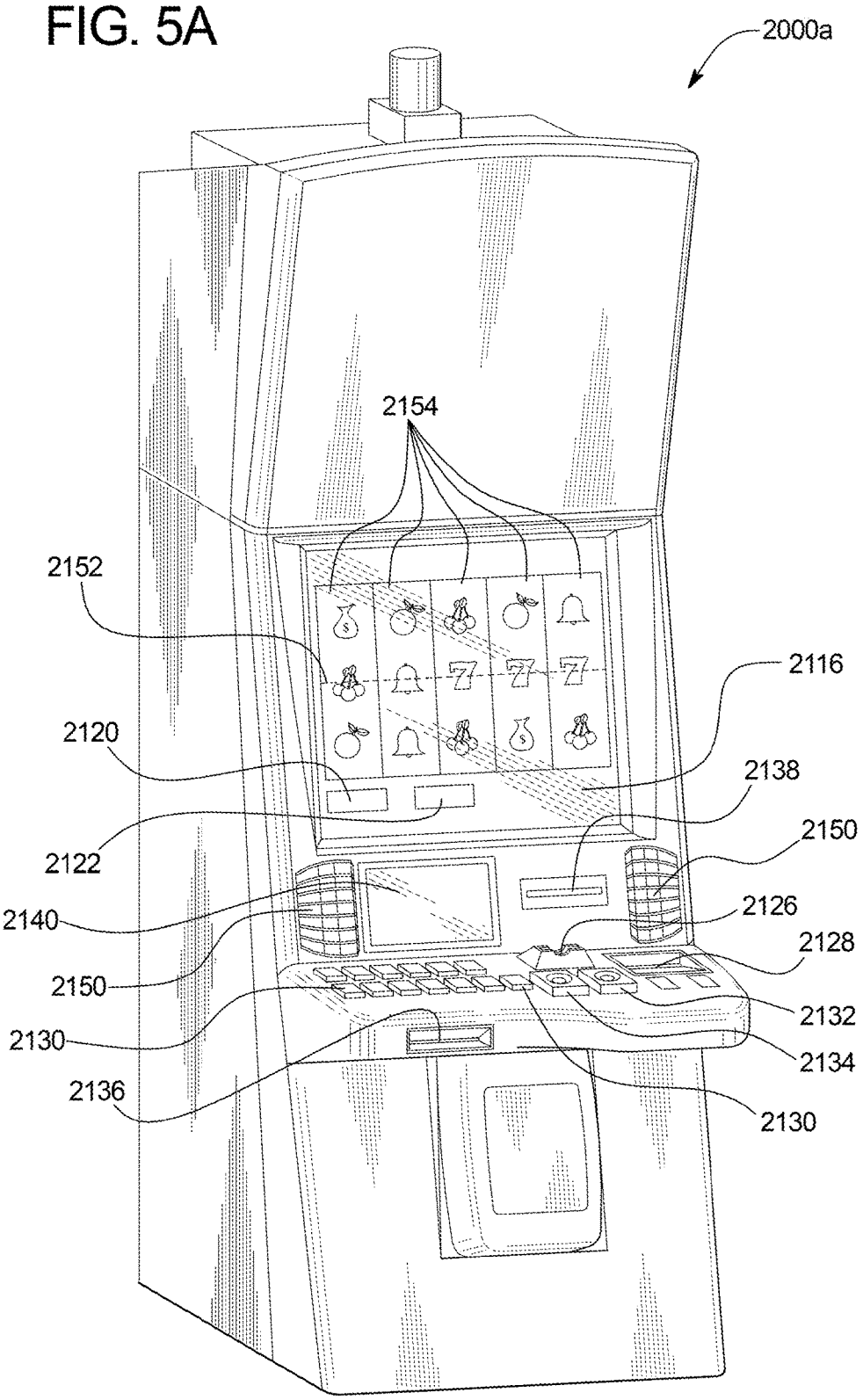
FIGS. 5A and 5B are perspective views of example alternative embodiments of the gaming system disclosed herein.
Figure 5B:
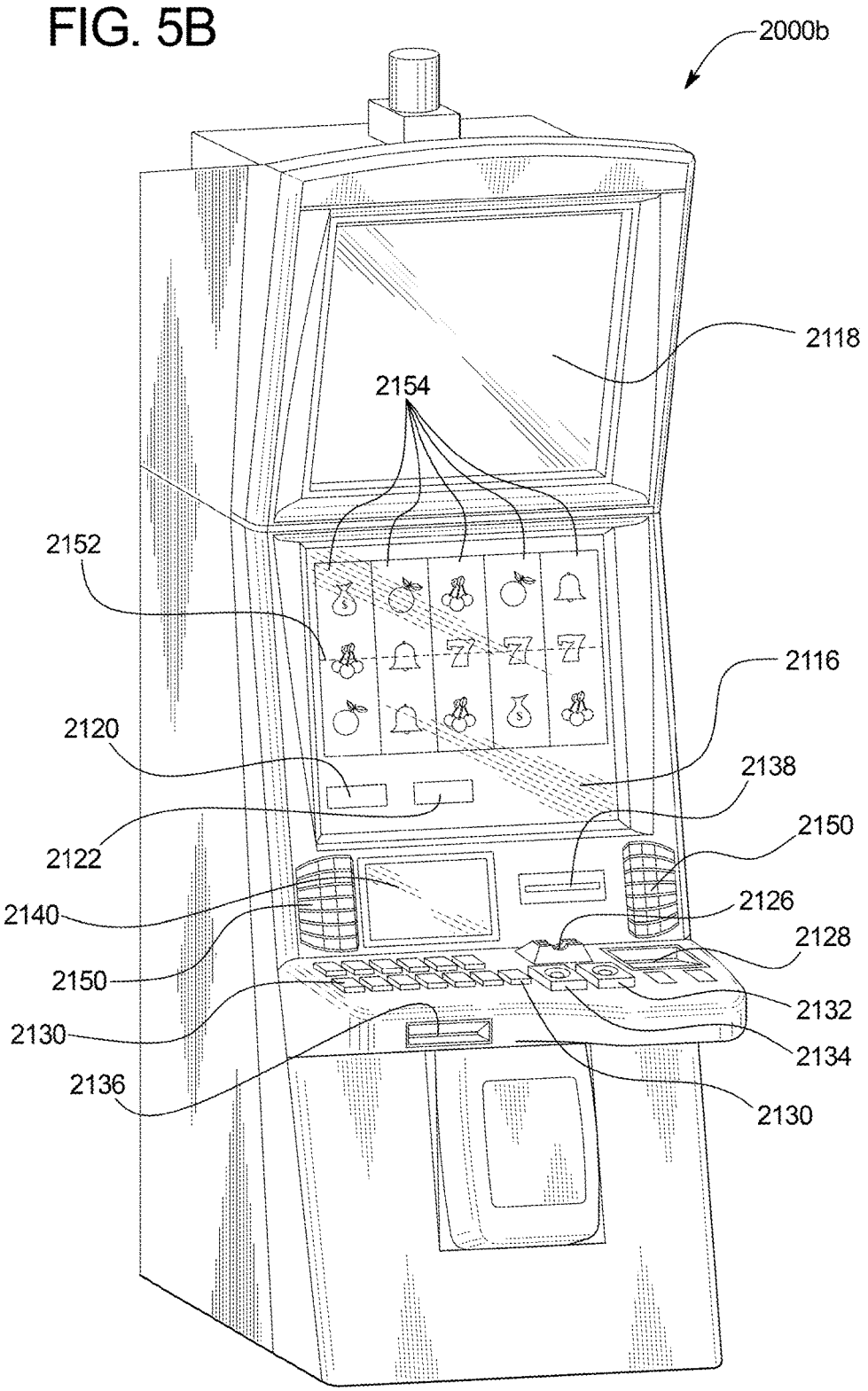

FIG. 4 is a block diagram of an example EGM 1000 and FIGS. 5A and 5B include two different example EGMs 2000*a* and 2000*b*. The EGMs 1000, 2000*a*, and 2000*b* are merely example EGMs, and different EGMs may be implemented using different combinations of the components shown in the EGMs 1000, 2000*a*, and 2000*b*.

In these embodiments, the EGM 1000 includes a master gaming controller 1012 configured to communicate with and to operate with a plurality of peripheral devices 1022.

The master gaming controller 1012 includes at least one processor 1010. The at least one processor 1010 is any suitable processing device or set of processing devices, such as a microprocessor, a microcontroller-based platform, a suitable integrated circuit, or one or more application-specific integrated circuits (ASICs), configured to execute software enabling various configuration and reconfiguration tasks, such as: (1) communicating with a remote source (such as a server that stores authentication information or game information) via a communication interface 1006 of the master gaming controller 1012; (2) converting signals read by an interface to a format corresponding to that used by software or memory of the EGM; (3) accessing memory to configure or reconfigure game parameters in the memory according to indicia read from the EGM; (4) communicating with interfaces and the peripheral devices 1022 (such as input/output devices); and/or (5) controlling the peripheral devices 1022. In certain embodiments, one or more components of the master gaming controller 1012 (such as the at least one processor 1010) reside within a housing of the EGM (described below), while in other embodiments at least one component of the master gaming controller 1012 resides outside of the housing of the EGM.

The master gaming controller 1012 also includes at least one memory device 1016, which includes: (1) volatile memory (e.g., RAM 1009, which can include non-volatile RAM, magnetic RAM, ferroelectric RAM, and any other suitable forms); (2) non-volatile memory 1019 (e.g., disk memory, FLASH memory, EPROMs, EEPROMs, memristor-based non-volatile solid-state memory, etc.); (3) unalterable memory (e.g., EPROMs 1008); (4) read-only memory; and/or (5) a secondary memory storage device 1015, such as a non-volatile memory device, configured to store gaming software related information (the gaming software related information and the memory may be used to store various audio files and games not currently being used and invoked in a configuration or reconfiguration). Any other suitable magnetic, optical, and/or semiconductor memory may operate in conjunction with the EGM disclosed herein. In certain embodiments, the at least one memory device 1016 resides within the housing of the EGM (described below), while in other embodiments at least one component of the at least one memory device 1016 resides outside of the housing of the EGM.

The at least one memory device 1016 is configured to store, for example: (1) configuration software 1014, such as all the parameters and settings for a game playable on the EGM; (2) associations 1018 between configuration indicia read from an EGM with one or more parameters and settings; (3) communication protocols configured to enable the at least one processor 1010 to communicate with the peripheral devices 1022; and/or (4) communication transport protocols (such as TCP/IP, USB, Firewire, IEEE1394, Bluetooth, IEEE 802.11x (IEEE 802.11 standards), hiperlan/2, HomeRF, etc.) configured to enable the EGM to communicate with local and non-local devices using such protocols. In one implementation, the master gaming controller 1012 communicates with other devices using a serial communication protocol. A few non-limiting examples of serial communication protocols that other devices, such as peripherals (e.g., a bill validator or a ticket printer), may use to communicate with the master game controller 1012 include USB, RS-232, and Netplex (a proprietary protocol developed by IGT).

In certain embodiments, the at least one memory device 1016 is configured to store program code and instructions executable by the at least one processor of the EGM to control the EGM. The at least one memory device 1016 of the EGM also stores other operating data, such as image data, event data, input data, random number generators (RNGs) or pseudo-RNGs, paytable data or information, and/or applicable game rules that relate to the play of one or more games on the EGM. In various embodiments, part or all of the program code and/or the operating data described above is stored in at least one detachable or removable memory device including, but not limited to, a cartridge, a disk, a CD ROM, a DVD, a USB memory device, or any other suitable non-transitory computer readable medium. In certain such embodiments, an operator (such as a gaming establishment operator) and/or a player uses such a removable memory device in an EGM to implement at least part of the present disclosure. In other embodiments, part or all of the program code and/or the operating data is downloaded to the at least one memory device of the EGM through any suitable data network described above (such as an Internet or intranet).

The at least one memory device 1016 also stores a plurality of device drivers 1042. Examples of different types of device drivers include device drivers for EGM components and device drivers for the peripheral components 1022. Typically, the device drivers 1042 utilize various communication protocols that enable communication with a particular physical device. The device driver abstracts the hardware implementation of that device. For example, a device driver may be written for each type of card reader that could potentially be connected to the EGM. Non-limiting examples of communication protocols used to implement the device drivers include Netplex, USB, Serial, Ethernet 175, Firewire, I/O debouncer, direct memory map, serial, PCI, parallel, RF, Bluetooth™, near-field communications (e.g., using near-field magnetics), 802.11 (WiFi), etc. In one embodiment, when one type of a particular device is exchanged for another type of the particular device, the at least one processor of the EGM loads the new device driver from the at least one memory device to enable communication with the new device. For instance, one type of card reader in the EGM can be replaced with a second different type of card reader when device drivers for both card readers are stored in the at least one memory device.

In certain embodiments, the software units stored in the at least one memory device 1016 can be upgraded as needed. For instance, when the at least one memory device 1016 is a hard drive, new games, new game options, new parameters, new settings for existing parameters, new settings for new parameters, new device drivers, and new communication protocols can be uploaded to the at least one memory device 1016 from the master game controller 1012 or from some other external device. As another example, when the at least one memory device 1016 includes a CD/DVD drive including a CD/DVD configured to store game options, parameters, and settings, the software stored in the at least one memory device 1016 can be upgraded by replacing a first CD/DVD with a second CD/DVD. In yet another example, when the at least one memory device 1016 uses flash memory 1019 or EPROM 1008 units configured to store games, game options, parameters, and settings, the software stored in the flash and/or EPROM memory units can be upgraded by replacing one or more memory units with new memory units that include the upgraded software. In another embodiment, one or more of the memory devices, such as the hard drive, may be employed in a game software download process from a remote software server.

In some embodiments, the at least one memory device 1016 also stores authentication and/or validation components 1044 configured to authenticate/validate specified EGM components and/or information, such as hardware components, software components, firmware components, peripheral device components, user input device components, information received from one or more user input devices, information stored in the at least one memory device 1016, etc. Examples of various authentication and/or validation components are described in U.S. Pat. No. 6,620,047, entitled "Electronic Gaming Apparatus Having Authentication Data Sets," which is incorporated herein by reference.

In certain embodiments, the peripheral devices 1022 include several device interfaces, such as: (1) at least one output device 1020 including at least one display device 1035; (2) at least one input device 1030 (which may include contact and/or non-contact interfaces); (3) at least one transponder 1054; (4) at least one wireless communication component 1056; (5) at least one wired/wireless power distribution component 1058; (6) at least one sensor 1060; (7) at least one data preservation component 1062; (8) at least one motion/gesture analysis and interpretation component 1064; (9) at least one motion detection component 1066; (10) at least one portable power source 1068; (11) at least one geolocation module 1076; (12) at least one user identification module 1077; (13) at least one player/device tracking module 1078; and (14) at least one information filtering module 1079.

The at least one output device 1020 includes at least one display device 1035 configured to display any game(s) displayed by the EGM and any suitable information associated with such game(s). In certain embodiments, the display devices are connected to or mounted on a housing of the EGM (described below). In various embodiments, the display devices serve as digital glass configured to advertise certain games or other aspects of the gaming establishment in which the EGM is located. In various embodiments, the EGM includes one or more of the following display devices: (a) a central display device; (b) a player tracking display configured to display various information regarding a player's player tracking status (as described below); (c) a secondary or upper display device in addition to the central display device and the player tracking display; (d) a credit display configured to display a current quantity of credits, amount of cash, account balance, or the equivalent; and (e) a bet display configured to display an amount wagered for one or more plays of one or more games. The example EGM 2000*a* illustrated in FIG. 5A includes a central display device 2116, a player tracking display 2140, a credit display 2120, and a bet display 2122. The example EGM 2000*b* illustrated in FIG. 5B includes a central display device 2116, an upper display device 2118, a player tracking display 2140, a credit display 2120, and a bet display 2122.

In various embodiments, the display devices include, without limitation: a monitor, a television display, a plasma display, a liquid crystal display (LCD), a display based on light emitting diodes (LEDs), a display based on a plurality of organic light-emitting diodes (OLEDs), a display based on polymer light-emitting diodes (PLEDs), a display based on a plurality of surface-conduction electron-emitters (SEDs), a display including a projected and/or reflected image, or any other suitable electronic device or display mechanism. In certain embodiments, as described above, the display device includes a touch-screen with an associated touch-screen controller. The display devices may be of any suitable sizes, shapes, and configurations.

The display devices of the EGM are configured to display one or more game and/or non-game images, symbols, and indicia. In certain embodiments, the display devices of the EGM are configured to display any suitable visual representation or exhibition of the movement of objects; dynamic lighting; video images; images of people, characters, places, things, and faces of cards; and the like. In certain embodiments, the display devices of the EGM are configured to display one or more video reels, one or more video wheels, and/or one or more video dice. In other embodiments, certain of the displayed images, symbols, and indicia are in mechanical form. That is, in these embodiments, the display device includes any electromechanical device, such as one or more rotatable wheels, one or more reels, and/or one or more dice, configured to display at least one or a plurality of game or other suitable images, symbols, or indicia.

In various embodiments, the at least one output device 1020 includes a payout device. In these embodiments, after the EGM receives an actuation of a cashout device (described below), the EGM causes the payout device to provide a payment to the player. In one embodiment, the payout device is one or more of: (a) a ticket printer and dispenser configured to print and dispense a ticket or credit slip associated with a monetary value, wherein the ticket or credit slip may be redeemed for its monetary value via a cashier, a kiosk, or other suitable redemption system; (b) a bill dispenser configured to dispense paper currency; (c) a coin dispenser configured to dispense coins or tokens (such as into a coin payout tray); and (d) any suitable combination thereof. The example EGMs 2000*a* and 2000*b* illustrated in FIGS. 5A and 5B each include a ticket printer and dispenser 2136. Examples of ticket-in ticket-out (TITO) technology are described in U.S. Pat. No. 5,429,361, entitled "Gaming Machine Information, Communication and Display System"; U.S. Pat. No. 5,470,079, entitled "Gaming Machine Accounting and Monitoring System"; U.S. Pat. No. 5,265,874, entitled "Cashless Gaming Apparatus and Method"; U.S. Pat. No. 6,729,957, entitled "Gaming Method and Host Computer with Ticket-In/Ticket-Out Capability"; U.S. Pat. No. 6,729,958, entitled "Gaming System with Ticket-In/Ticket-Out Capability"; U.S. Pat. No. 6,736,725, entitled "Gaming Method and Host Computer with Ticket-In/Ticket-Out Capability"; U.S. Pat. No. 7,275,991, entitled "Slot Machine with Ticket-In/Ticket-Out Capability"; U.S. Pat. No. 6,048,269, entitled "Coinless Slot Machine System and Method"; and U.S. Pat. No. 5,290,003, entitled "Gaming Machine and Coupons," which are incorporated herein by reference.

In certain embodiments, rather than dispensing bills, coins, or a physical ticket having a monetary value to the player following receipt of an actuation of the cashout device, the payout device is configured to cause a payment to be provided to the player in the form of an electronic funds transfer, such as via a direct deposit into a bank account, a casino account, or a prepaid account of the player; via a transfer of funds onto an electronically recordable identification card or smart card of the player; or via sending a virtual ticket having a monetary value to an electronic device of the player. Examples of providing payment using virtual tickets are described in U.S. Pat. No. 8,613,659, entitled "Virtual Ticket-In and Ticket-Out on a Gaming Machine," which is incorporated herein by reference.

While any credit balances, any wagers, any values, and any awards are described herein as amounts of monetary credits or currency, one or more of such credit balances, such wagers, such values, and such awards may be for non-monetary credits, promotional credits, of player tracking points or credits.

In certain embodiments, the at least one output device 1020 is a sound generating device controlled by one or more sound cards. In one such embodiment, the sound generating device includes one or more speakers or other sound generating hardware and/or software configured to generate sounds, such as by playing music for any games or by playing music for other modes of the EGM, such as an attract mode. The example EGMs 2000*a* and 2000*b* illustrated in FIGS. 5A and 5B each include a plurality of speakers 2150. In another such embodiment, the EGM provides dynamic sounds coupled with attractive multimedia images displayed on one or more of the display devices to provide an audio-visual representation or to otherwise display full-motion video with sound to attract players to the EGM. In certain embodiments, the EGM displays a sequence of audio and/or visual attraction messages during idle periods to attract potential players to the EGM. The videos may be customized to provide any appropriate information.

The at least one input device 1030 may include any suitable device that enables an input signal to be produced and received by the at least one processor 1010 of the EGM.

In one embodiment, the at least one input device 1030 includes a payment device configured to communicate with the at least one processor of the EGM to fund the EGM. In certain embodiments, the payment device includes one or more of: (a) a bill acceptor into which paper money is inserted to fund the EGM; (b) a ticket acceptor into which a ticket or a voucher is inserted to fund the EGM; (c) a coin slot into which coins or tokens are inserted to fund the EGM; (d) a reader or a validator for credit cards, debit cards, or credit slips into which a credit card, debit card, or credit slip is inserted to fund the EGM; (e) a player identification card reader into which a player identification card is inserted to fund the EGM; or (f) any suitable combination thereof. The example EGMs 2000*a* and 2000*b* illustrates in FIGS. 5A and 5B each include a combined bill and ticket acceptor 2128 and a coin slot 2126.

In one embodiment, the at least one input device 1030 includes a payment device configured to enable the EGM to be funded via an electronic funds transfer, such as a transfer of funds from a bank account. In another embodiment, the EGM includes a payment device configured to communicate with a mobile device of a player, such as a mobile phone, a radio frequency identification tag, or any other suitable wired or wireless device, to retrieve relevant information associated with that player to fund the EGM. Examples of funding an EGM via communication between the EGM and a mobile device (such as a mobile phone) of a player are described in U.S. Patent Application Publication No. 2013/0344942, entitled "Avatar as Security Measure for Mobile Device Use with Electronic Gaming Machine," which is incorporated herein by reference. When the EGM is funded, the at least one processor determines the amount of funds entered and displays the corresponding amount on a credit display or any other suitable display as described below.

In certain embodiments, the at least one input device 1030 includes at least one wagering or betting device. In various embodiments, the one or more wagering or betting devices are each: (1) a mechanical button supported by the housing of the EGM (such as a hard key or a programmable soft key), or (2) an icon displayed on a display device of the EGM (described below) that is actuatable via a touch screen of the EGM (described below) or via use of a suitable input device of the EGM (such as a mouse or a joystick). One such wagering or betting device is as a maximum wager or bet device that, when actuated, causes the EGM to place a maximum wager on a play of a game. Another such wagering or betting device is a repeat bet device that, when actuated, causes the EGM to place a wager that is equal to the previously-placed wager on a play of a game. A further such wagering or betting device is a bet one device that, when actuated, causes the EGM to increase the wager by one credit. Generally, upon actuation of one of the wagering or betting devices, the quantity of credits displayed in a credit meter (described below) decreases by the amount of credits wagered, while the quantity of credits displayed in a bet display (described below) increases by the amount of credits wagered.

In various embodiments, the at least one input device 1030 includes at least one game play activation device. In various embodiments, the one or more game play initiation devices are each: (1) a mechanical button supported by the housing of the EGM (such as a hard key or a programmable soft key), or (2) an icon displayed on a display device of the EGM (described below) that is actuatable via a touch screen of the EGM (described below) or via use of a suitable input device of the EGM (such as a mouse or a joystick). After a player appropriately funds the EGM and places a wager, the EGM activates the game play activation device to enable the player to actuate the game play activation device to initiate a play of a game on the EGM (or another suitable sequence of events associated with the EGM). After the EGM receives an actuation of the game play activation device, the EGM initiates the play of the game. The example EGMs 2000*a* and 2000*b* illustrated in FIGS. 5A and 5B each include a game play activation device in the form of a game play initiation button 2132. In other embodiments, the EGM begins game play automatically upon appropriate funding rather than upon utilization of the game play activation device.

In other embodiments, the at least one input device 1030 includes a cashout device. In various embodiments, the cashout device is: (1) a mechanical button supported by the housing of the EGM (such as a hard key or a programmable soft key), or (2) an icon displayed on a display device of the EGM (described below) that is actuatable via a touch screen of the EGM (described below) or via use of a suitable input device of the EGM (such as a mouse or a joystick). When the EGM receives an actuation of the cashout device from a player and the player has a positive (i.e., greater-than-zero) credit balance, the EGM initiates a payout associated with the player's credit balance. The example EGMs 2000*a* and 2000*b* illustrated in FIGS. 5A and 5B each include a cashout device in the form of a cashout button 2134.

In various embodiments, the at least one input device 1030 includes a plurality of buttons that are programmable by the EGM operator to, when actuated, cause the EGM to perform particular functions. For instance, such buttons may be hard keys, programmable soft keys, or icons icon displayed on a display device of the EGM (described below) that are actuatable via a touch screen of the EGM (described below) or via use of a suitable input device of the EGM (such as a mouse or a joystick). The example EGMs 2000*a* and 2000*b* illustrated in FIGS. 5A and 5B each include a plurality of such buttons 2130.

In certain embodiments, the at least one input device 1030 includes a touch-screen coupled to a touch-screen controller or other touch-sensitive display overlay to enable interaction with any images displayed on a display device (as described below). One such input device is a conventional touch-screen button panel. The touch-screen and the touch-screen controller are connected to a video controller. In these embodiments, signals are input to the EGM by touching the touch screen at the appropriate locations.

In embodiments including a player tracking system, as further described below, the at least one input device 1030 includes a card reader in communication with the at least one processor of the EGM. The example EGMs 2000*a* and 2000*b* illustrated in FIGS. 5A and 5B each include a card reader 2138. The card reader is configured to read a player identification card inserted into the card reader.

The at least one wireless communication component 1056 includes one or more communication interfaces having different architectures and utilizing a variety of protocols, such as (but not limited to) 802.11 (WiFi); 802.15 (including Bluetooth™); 802.16 (WiMax); 802.22; cellular standards such as CDMA, CDMA2000, and WCDMA; Radio Frequency (e.g., RFID); infrared; and Near Field Magnetic communication protocols. The at least one wireless communication component 1056 transmits electrical, electromagnetic, or optical signals that carry digital data streams or analog signals representing various types of information.

The at least one wired/wireless power distribution component 1058 includes components or devices that are configured to provide power to other devices. For example, in one embodiment, the at least one power distribution component 1058 includes a magnetic induction system that is configured to provide wireless power to one or more user input devices near the EGM. In one embodiment, a user input device docking region is provided, and includes a power distribution component that is configured to recharge a user input device without requiring metal-to-metal contact. In one embodiment, the at least one power distribution component 1058 is configured to distribute power to one or more internal components of the EGM, such as one or more rechargeable power sources (e.g., rechargeable batteries) located at the EGM.

In certain embodiments, the at least one sensor 1060 includes at least one of: optical sensors, pressure sensors, RF sensors, infrared sensors, image sensors, thermal sensors, and biometric sensors. The at least one sensor 1060 may be used for a variety of functions, such as: detecting movements and/or gestures of various objects within a predetermined proximity to the EGM; detecting the presence and/or identity of various persons (e.g., players, casino employees, etc.), devices (e.g., user input devices), and/or systems within a predetermined proximity to the EGM.

The at least one data preservation component 1062 is configured to detect or sense one or more events and/or conditions that, for example, may result in damage to the EGM and/or that may result in loss of information associated with the EGM. Additionally, the data preservation system 1062 may be operable to initiate one or more appropriate action(s) in response to the detection of such events/conditions.

The at least one motion/gesture analysis and interpretation component 1064 is configured to analyze and/or interpret information relating to detected player movements and/or gestures to determine appropriate player input information relating to the detected player movements and/or gestures. For example, in one embodiment, the at least one motion/gesture analysis and interpretation component 1064 is configured to perform one or more of the following functions: analyze the detected gross motion or gestures of a player; interpret the player's motion or gestures (e.g., in the context of a casino game being played) to identify instructions or input from the player; utilize the interpreted instructions/ input to advance the game state; etc. In other embodiments, at least a portion of these additional functions may be implemented at a remote system or device.

The at least one portable power source 1068 enables the EGM to operate in a mobile environment. For example, in one embodiment, the EGM 300 includes one or more rechargeable batteries.

The at least one geolocation module 1076 is configured to acquire geolocation information from one or more remote sources and use the acquired geolocation information to determine information relating to a relative and/or absolute position of the EGM. For example, in one implementation, the at least one geolocation module 1076 is configured to receive GPS signal information for use in determining the position or location of the EGM. In another implementation, the at least one geolocation module 1076 is configured to receive multiple wireless signals from multiple remote devices (e.g., EGMs, servers, wireless access points, etc.) and use the signal information to compute position/location information relating to the position or location of the EGM.

The at least one user identification module 1077 is configured to determine the identity of the current user or current owner of the EGM. For example, in one embodiment, the current user is required to perform a login process at the EGM in order to access one or more features. Alternatively, the EGM is configured to automatically determine the identity of the current user based on one or more external signals, such as an RFID tag or badge worn by the current user and that provides a wireless signal to the EGM that is used to determine the identity of the current user. In at least one embodiment, various security features are incorporated into the EGM to prevent unauthorized users from accessing confidential or sensitive information.

The at least one information filtering module 1079 is configured to perform filtering (e.g., based on specified criteria) of selected information to be displayed at one or more displays 1035 of the EGM.

In various embodiments, the EGM includes a plurality of communication ports configured to enable the at least one processor of the EGM to communicate with and to operate with external peripherals, such as: accelerometers, arcade sticks, bar code readers, bill validators, biometric input devices, bonus devices, button panels, card readers, coin dispensers, coin hoppers, display screens or other displays or video sources, expansion buses, information panels, keypads, lights, mass storage devices, microphones, motion sensors, motors, printers, reels, SCSI ports, solenoids, speakers, thumbsticks, ticket readers, touch screens, trackballs, touchpads, wheels, and wireless communication devices. U.S. Pat. No. 7,290,072 describes a variety of EGMs including one or more communication ports that enable the EGMs to communicate and operate with one or more external peripherals.

As generally described above, in certain embodiments, such as the example EGMs 2000*a* and 2000*b* illustrated in FIGS. 5A and 5B, the EGM has a support structure, housing, or cabinet that provides support for a plurality of the input devices and the output devices of the EGM. Further, the EGM is configured such that a player may operate it while standing or sitting. In various embodiments, the EGM is positioned on a base or stand, or is configured as a pub-style tabletop game (not shown) that a player may operate typically while sitting. As illustrated by the different example EGMs 2000*a* and 2000*b* shown in FIGS. 5A and 5B, EGMs may have varying housing and display configurations.

In certain embodiments, the EGM is a device that has obtained approval from a regulatory gaming commission, and in other embodiments, the EGM is a device that has not obtained approval from a regulatory gaming commission.

The EGMs described above are merely three examples of different types of EGMs. Certain of these example EGMs may include one or more elements that may not be included in all gaming systems, and these example EGMs may not include one or more elements that are included in other gaming systems. For example, certain EGMs include a coin acceptor while others do not.

Operation of Primary or Base Games and/or Secondary or Bonus Games

In various embodiments, an EGM may be implemented in one of a variety of different configurations. In various embodiments, the EGM may be implemented as one of: (a) a dedicated EGM in which computerized game programs executable by the EGM for controlling any primary or base games (referred to herein as "primary games") and/or any secondary or bonus games or other functions displayed by the EGM are provided with the EGM prior to delivery to a gaming establishment or prior to being provided to a player; and (b) a changeable EGM in which computerized game programs executable by the EGM for controlling any primary games and/or secondary games displayed by the EGM are downloadable or otherwise transferred to the EGM through a data network or remote communication link; from a USB drive, flash memory card, or other suitable memory device; or in any other suitable manner after the EGM is physically located in a gaming establishment or after the EGM is provided to a player.

As generally explained above, in various embodiments in which the gaming system includes a central server, central controller, or remote host and a changeable EGM, the at least one memory device of the central server, central controller, or remote host stores different game programs and instructions executable by the at least one processor of the changeable EGM to control one or more primary games and/or secondary games displayed by the changeable EGM. More specifically, each such executable game program represents a different game or a different type of game that the at least one changeable EGM is configured to operate. In one example, certain of the game programs are executable by the changeable EGM to operate games having the same or substantially the same game play but different paytables. In different embodiments, each executable game program is associated with a primary game, a secondary game, or both. In certain embodiments, an executable game program is executable by the at least one processor of the at least one changeable EGM as a secondary game to be played simultaneously with a play of a primary game (which may be downloaded to or otherwise stored on the at least one changeable EGM), or vice versa.

In operation of such embodiments, the central server, central controller, or remote host is configured to communicate one or more of the stored executable game programs to the at least one processor of the changeable EGM. In different embodiments, a stored executable game program is communicated or delivered to the at least one processor of the changeable EGM by: (a) embedding the executable game program in a device or a component (such as a microchip to be inserted into the changeable EGM); (b) writing the executable game program onto a disc or other media; or (c) uploading or streaming the executable game program over a data network (such as a dedicated data network). After the executable game program is communicated from the central server, central controller, or remote host to the changeable EGM, the at least one processor of the changeable EGM executes the executable game program to enable the primary game and/or the secondary game associated with that executable game program to be played using the display device(s) and/or the input device(s) of the changeable EGM. That is, when an executable game program is communicated to the at least one processor of the changeable EGM, the at least one processor of the changeable EGM changes the game or the type of game that may be played using the changeable EGM.

In certain embodiments, the gaming system randomly determines any game outcome(s) (such as a win outcome) and/or award(s) (such as a quantity of credits to award for the win outcome) for a play of a primary game and/or a play of a secondary game based on probability data. In certain such embodiments, this random determination is provided through utilization of an RNG, such as a true RNG or a pseudo RNG, or any other suitable randomization process. In one such embodiment, each game outcome or award is associated with a probability, and the gaming system generates the game outcome(s) and/or the award(s) to be provided based on the associated probabilities. In these embodiments, since the gaming system generates game outcomes and/or awards randomly or based on one or more probability calculations, there is no certainty that the gaming system will ever provide any specific game outcome and/or award.

In certain embodiments, the gaming system maintains one or more predetermined pools or sets of predetermined game outcomes and/or awards. In certain such embodiments, upon generation or receipt of a game outcome and/or award request, the gaming system independently selects one of the predetermined game outcomes and/or awards from the one or more pools or sets. The gaming system flags or marks the selected game outcome and/or award as used. Once a game outcome or an award is flagged as used, it is prevented from further selection from its respective pool or set; that is, the gaming system does not select that game outcome or award upon another game outcome and/or award request. The gaming system provides the selected game outcome and/or award. Examples of this type of award evaluation are described in U.S. Pat. No. 7,470,183, entitled "Finite Pool Gaming Method and Apparatus"; U.S. Pat. No. 7,563,163, entitled "Gaming Device Including Outcome Pools for Providing Game Outcomes"; U.S. Pat. No. 7,833,092, entitled "Method and System for Compensating for Player Choice in a Game of Chance"; U.S. Pat. No. 8,070,579, entitled "Bingo System with Downloadable Common Patterns"; and U.S. Pat. No. 8,398,472, entitled "Central Determination Poker Game," which are incorporated herein by reference.

In certain embodiments, the gaming system determines a predetermined game outcome and/or award based on the results of a bingo, keno, or lottery game. In certain such embodiments, the gaming system utilizes one or more bingo, keno, or lottery games to determine the predetermined game outcome and/or award provided for a primary game and/or a secondary game. The gaming system is provided or associated with a bingo card. Each bingo card consists of a matrix or array of elements, wherein each element is designated with separate indicia. After a bingo card is provided, the gaming system randomly selects or draws a plurality of the elements. As each element is selected, a determination is made as to whether the selected element is present on the bingo card. If the selected element is present on the bingo card, that selected element on the provided bingo card is marked or flagged. This process of selecting elements and marking any selected elements on the provided bingo cards continues until one or more predetermined patterns are marked on one or more of the provided bingo cards. After one or more predetermined patterns are marked on one or more of the provided bingo cards, game outcome and/or award is determined based, at least in part, on the selected elements on the provided bingo cards. Examples of this type of award determination are described in U.S. Pat. No. 7,753,774, entitled "Using Multiple Bingo Cards to Represent Multiple Slot Paylines and Other Class III Game Options"; U.S. Pat. No. 7,731,581, entitled "Multi-Player Bingo Game with Multiple Alternative Outcome Displays"; U.S. Pat. No. 7,955,170, entitled "Providing Non-Bingo Outcomes for a Bingo Game"; U.S. Pat. No. 8,070,579, entitled "Bingo System with Downloadable Common Patterns"; and U.S. Pat. No. 8,500,538, entitled "Bingo Gaming System and Method for Providing Multiple Outcomes from Single Bingo Pattern," which are incorporated herein by reference.

In certain embodiments in which the gaming system includes a central server, central controller, or remote host and an EGM, the EGM is configured to communicate with the central server, central controller, or remote host for monitoring purposes only. In such embodiments, the EGM determines the game outcome(s) and/or award(s) to be provided in any of the manners described above, and the central server, central controller, or remote host monitors the activities and events occurring on the EGM. In one such embodiment, the gaming system includes a real-time or online accounting and gaming information system configured to communicate with the central server, central controller, or remote host. In this embodiment, the accounting and gaming information system includes: (a) a player database configured to store player profiles, (b) a player tracking module configured to track players (as described below), and (c) a credit system configured to provide automated transactions. Examples of such accounting systems are described in U.S. Pat. No. 6,913,534, entitled "Gaming Machine Having a Lottery Game and Capability for Integration with Gaming Device Accounting System and Player Tracking System," and U.S. Pat. No. 8,597,116, entitled "Virtual Player Tracking and Related Services," which are incorporated herein by reference.

As noted above, in various embodiments, the gaming system includes one or more executable game programs executable by at least one processor of the gaming system to provide one or more primary games and one or more secondary games. The primary game(s) and the secondary game(s) may comprise any suitable games and/or wagering games, such as, but not limited to: electro-mechanical or video slot or spinning reel type games; video card games such as video draw poker, multi-hand video draw poker, other video poker games, video blackjack games, and video baccarat games; video keno games; video bingo games; and video selection games.

In certain embodiments in which the primary game is a slot or spinning reel type game, the gaming system includes one or more reels in either an electromechanical form with mechanical rotating reels or in a video form with simulated reels and movement thereof. Each reel displays a plurality of indicia or symbols, such as bells, hearts, fruits, numbers, letters, bars, or other images that typically correspond to a theme associated with the gaming system. In certain such embodiments, the gaming system includes one or more paylines associated with the reels. The example EGM **2000*b* shown in FIG. 5B includes a payline 1152 and a plurality of reels 1154**. In certain embodiments, one or more of the reels are independent reels or unisymbol reels. In such embodiments, each independent reel generates and displays one symbol.

In various embodiments, one or more of the paylines is horizontal, vertical, circular, diagonal, angled, or any suitable combination thereof. In other embodiments, each of one or more of the paylines is associated with a plurality of adjacent symbol display areas on a requisite number of adjacent reels. In one such embodiment, one or more paylines are formed between at least two symbol display areas that are adjacent to each other by either sharing a common side or sharing a common corner (i.e., such paylines are connected paylines). The gaming system enables a wager to be placed on one or more of such paylines to activate such paylines. In other embodiments in which one or more paylines are formed between at least two adjacent symbol display areas, the gaming system enables a wager to be placed on a plurality of symbol display areas, which activates those symbol display areas.

In various embodiments, the gaming system provides one or more awards after a spin of the reels when specified types and/or configurations of the indicia or symbols on the reels occur on an active payline or otherwise occur in a winning pattern, occur on the requisite number of adjacent reels, and/or occur in a scatter pay arrangement.

In certain embodiments, the gaming system employs a ways to win award determination. In these embodiments, any outcome to be provided is determined based on a number of associated symbols that are generated in active symbol display areas on the requisite number of adjacent reels (i.e., not on paylines passing through any displayed winning symbol combinations). If a winning symbol combination is generated on the reels, one award for that occurrence of the generated winning symbol combination is provided. Examples of ways to win award determinations are described in U.S. Pat. No. 8,012,011, entitled "Gaming Device and Method Having Independent Reels and Multiple Ways of Winning"; U.S. Pat. No. 8,241,104, entitled "Gaming Device and Method Having Designated Rules for Determining Ways To Win"; and U.S. Pat. No. 8,430,739, entitled "Gaming System and Method Having Wager Dependent Different Symbol Evaluations," which are incorporated herein by reference.

In various embodiments, the gaming system includes a progressive award. Typically, a progressive award includes an initial amount and an additional amount funded through a portion of each wager placed to initiate a play of a primary game. When one or more triggering events occurs, the gaming system provides at least a portion of the progressive award. After the gaming system provides the progressive award, an amount of the progressive award is reset to the initial amount and a portion of each subsequent wager is allocated to the next progressive award. Examples of progressive gaming systems are described in U.S. Pat. No. 7,585,223, entitled "Server Based Gaming System Having Multiple Progressive Awards"; U.S. Pat. No. 7,651,392, entitled "Gaming Device System Having Partial Progressive Payout"; U.S. Pat. No. 7,666,093, entitled "Gaming Method and Device Involving Progressive Wagers"; U.S. Pat. No. 7,780,523, entitled "Server Based Gaming System Having Multiple Progressive Awards"; and U.S. Pat. No. 8,337,298, entitled "Gaming Device Having Multiple Different Types of Progressive Awards," which are incorporated herein by reference As generally noted above, in addition to providing winning credits or other awards for one or more plays of the primary game(s), in various embodiments the gaming system provides credits or other awards for one or more plays of one or more secondary games. The secondary game typically enables an award to be obtained addition to any award obtained through play of the primary game(s). The secondary game(s) typically produces a higher level of player excitement than the primary game(s) because the secondary game(s) provides a greater expectation of winning than the primary game(s) and is accompanied with more attractive or unusual features than the primary game(s). The secondary game(s) may be any type of suitable game, either similar to or completely different from the primary game.

In various embodiments, the gaming system automatically provides or initiates the secondary game upon the occurrence of a triggering event or the satisfaction of a qualifying condition. In other embodiments, the gaming system initiates the secondary game upon the occurrence of the triggering event or the satisfaction of the qualifying condition and upon receipt of an initiation input. In certain embodiments, the triggering event or qualifying condition is a selected outcome in the primary game(s) or a particular arrangement of one or more indicia on a display device for a play of the primary game(s), such as a "BONUS" symbol appearing on three adjacent reels along a payline following a spin of the reels for a play of the primary game. In other embodiments, the triggering event or qualifying condition occurs based on a certain amount of game play (such as number of games, number of credits, amount of time) being exceeded, or based on a specified number of points being earned during game play. Any suitable triggering event or qualifying condition or any suitable combination of a plurality of different triggering events or qualifying conditions may be employed.

In other embodiments, at least one processor of the gaming system randomly determines when to provide one or more plays of one or more secondary games. In one such embodiment, no apparent reason is provided for providing the secondary game. In this embodiment, qualifying for a secondary game is not triggered by the occurrence of an event in any primary game or based specifically on any of the plays of any primary game. That is, qualification is provided without any explanation or, alternatively, with a simple explanation. In another such embodiment, the gaming system determines qualification for a secondary game at least partially based on a game triggered or symbol triggered event, such as at least partially based on play of a primary game.

In various embodiments, after qualification for a secondary game has been determined, the secondary game participation may be enhanced through continued play on the primary game. Thus, in certain embodiments, for each secondary game qualifying event, such as a secondary game symbol, that is obtained, a given number of secondary game wagering points or credits is accumulated in a "secondary game meter" configured to accrue the secondary game wagering credits or entries toward eventual participation in the secondary game. In one such embodiment, the occurrence of multiple such secondary game qualifying events in the primary game results in an arithmetic or exponential increase in the number of secondary game wagering credits awarded. In another such embodiment, any extra secondary game wagering credits may be redeemed during the secondary game to extend play of the secondary game.

In certain embodiments, no separate entry fee or buy-in for the secondary game is required. That is, entry into the secondary game cannot be purchased; rather, in these embodiments entry must be won or earned through play of the primary game, thereby encouraging play of the primary game. In other embodiments, qualification for the secondary game is accomplished through a simple "buy-in." For example, qualification through other specified activities is unsuccessful, payment of a fee or placement of an additional wager "buys-in" to the secondary game. In certain embodiments, a separate side wager must be placed on the secondary game or a wager of a designated amount must be placed on the primary game to enable qualification for the secondary game. In these embodiments, the secondary game triggering event must occur and the side wager (or designated primary game wager amount) must have been placed for the secondary game to trigger.

In various embodiments in which the gaming system includes a plurality of EGMs, the EGMs are configured to communicate with one another to provide a group gaming environment. In certain such embodiments, the EGMs enable players of those EGMs to work in conjunction with one another, such as by enabling the players to play together as a team or group, to win one or more awards. In other such embodiments, the EGMs enable players of those EGMs to compete against one another for one or more awards. In one such embodiment, the EGMs enable the players of those EGMs to participate in one or more gaming tournaments for one or more awards. Examples of group gaming systems are described in U.S. Pat. No. 8,070,583, entitled "Server Based Gaming System and Method for Selectively Providing One or More Different Tournaments"; U.S. Pat. No. 8,500,548, entitled "Gaming System and Method for Providing Team Progressive Awards"; and U.S. Pat. No. 8,562,423, entitled "Method and Apparatus for Rewarding Multiple Game Players for a Single Win," which are incorporated herein by reference.

In various embodiments, the gaming system includes one or more player tracking systems. Such player tracking systems enable operators of the gaming system (such as casinos or other gaming establishments) to recognize the value of customer loyalty by identifying frequent customers and rewarding them for their patronage. Such a player tracking system is configured to track a player's gaming activity. In one such embodiment, the player tracking system does so through the use of player tracking cards. In this embodiment, a player is issued a player identification card that has an encoded player identification number that uniquely identifies the player. When the player's playing tracking card is inserted into a card reader of the gaming system to begin a gaming session, the card reader reads the player identification number off the player tracking card to identify the player. The gaming system timely tracks any suitable information or data relating to the identified player's gaming session. The gaming system also timely tracks when the player tracking card is removed to conclude play for that gaming session. In another embodiment, rather than requiring insertion of a player tracking card into the card reader, the gaming system utilizes one or more portable devices, such as a mobile phone, a radio frequency identification tag, or any other suitable wireless device, to track when a gaming session begins and ends. In another embodiment, the gaming system utilizes any suitable biometric technology or ticket technology to track when a gaming session begins and ends.

In such embodiments, during one or more gaming sessions, the gaming system tracks any suitable information or data, such as any amounts wagered, average wager amounts, and/or the time at which these wagers are placed. In different embodiments, for one or more players, the player tracking system includes the player's account number, the player's card number, the player's first name, the player's surname, the player's preferred name, the player's player tracking ranking, any promotion status associated with the player's player tracking card, the player's address, the player's birthday, the player's anniversary, the player's recent gaming sessions, or any other suitable data. In various embodiments, such tracked information and/or any suitable feature associated with the player tracking system is displayed on a player tracking display. In various embodiments, such tracked information and/or any suitable feature associated with the player tracking system is displayed via one or more service windows that are displayed on the central display device and/or the upper display device. Examples of player tracking systems are described in U.S. Pat. No. 6,722,985, entitled "Universal Player Tracking System"; U.S. Pat. No. 6,908,387, entitled "Player Tracking Communication Mechanisms in a Gaming Machine"; U.S. Pat. No. 7,311,605, entitled "Player Tracking Assembly for Complete Patron Tracking for Both Gaming and Non-Gaming Casino Activity"; U.S. Pat. No. 7,611,411, entitled "Player Tracking Instruments Having Multiple Communication Modes"; U.S. Pat. No. 7,617,151, entitled "Alternative Player Tracking Techniques"; and U.S. Pat. No. 8,057,298, entitled "Virtual Player Tracking and Related Services," which are incorporated herein by reference.

Differentiating Certain Gaming Systems from General Purpose Computing Devices Certain of the gaming systems described herein, such as EGMs located in a casino or another gaming establishment, include certain components and/or are configured to operate in certain manners that differentiate these systems from general purpose computing devices, i.e., certain personal gaming devices such as desktop computers and laptop computers.

For instance, EGMs are highly regulated to ensure fairness and, in many cases, EGMs are configured to award monetary awards up to multiple millions of dollars. To satisfy security and regulatory requirements in a gaming environment, hardware and/or software architectures are implemented in EGMs that differ significantly from those of general purpose computing devices. For purposes of illustration, a description of EGMs relative to general purpose computing devices and some examples of these additional (or different) hardware and/or software architectures found in EGMs are described below.

At first glance, one might think that adapting general purpose computing device technologies to the gaming industry and EGMs would be a simple proposition because both general purpose computing devices and EGMs employ processors that control a variety of devices. However, due to at least: (1) the regulatory requirements placed on EGMs, (2) the harsh environment in which EGMs operate, (3) security requirements, and (4) fault tolerance requirements, adapting general purpose computing device technologies to EGMs can be quite difficult. Further, techniques and methods for solving a problem in the general purpose computing device industry, such as device compatibility and connectivity issues, might not be adequate in the gaming industry. For instance, a fault or a weakness tolerated in a general purpose computing device, such as security holes in software or frequent crashes, is not tolerated in an EGM because in an EGM these faults can lead to a direct loss of funds from the EGM, such as stolen cash or loss of revenue when the EGM is not operating properly or when the random outcome determination is manipulated.

Certain differences between general purpose computing devices and EGMs are described below. A first difference between EGMs and general purpose computing devices is that EGMs are state-based systems. A state-based system stores and maintains its current state in a non-volatile memory such that, in the event of a power failure or other malfunction, the state-based system can return to that state when the power is restored or the malfunction is remedied. For instance, for a state-based EGM, if the EGM displays an award for a game of chance but the power to the EGM fails before the EGM provides the award to the player, the EGM stores the pre-power failure state in a non-volatile memory, returns to that state upon restoration of power, and provides the award to the player. This requirement affects the software and hardware design on EGMs. General purpose computing devices are not state-based machines, and a majority of data is usually lost when a malfunction occurs on a general purpose computing device.

A second difference between EGMs and general purpose computing devices is that, for regulatory purposes, the software on the EGM utilized to operate the EGM has been designed to be static and monolithic to prevent cheating by the operator of the EGM. For instance, one solution that has been employed in the gaming industry to prevent cheating and to satisfy regulatory requirements has been to manufacture an EGM that can use a proprietary processor running instructions to provide the game of chance from an EPROM or other form of non-volatile memory. The coding instructions on the EPROM are static (non-changeable) and must be approved by a gaming regulators in a particular jurisdiction and installed in the presence of a person representing the gaming jurisdiction. Any changes to any part of the software required to generate the game of chance, such as adding a new device driver used to operate a device during generation of the game of chance, can require burning a new EPROM approved by the gaming jurisdiction and reinstalling the new EPROM on the EGM in the presence of a gaming regulator. Regardless of whether the EPROM solution is used, to gain approval in most gaming jurisdictions, an EGM must demonstrate sufficient safeguards that prevent an operator or a player of an EGM from manipulating the EGM's hardware and software in a manner that gives him an unfair, and in some cases illegal, advantage.

A third difference between EGMs and general purpose computing devices is authentication—EGMs storing code are configured to authenticate the code to determine if the code is unaltered before executing the code. If the code has been altered, the EGM prevents the code from being executed. The code authentication requirements in the gaming industry affect both hardware and software designs on EGMs. Certain EGMs use hash functions to authenticate code. For instance, one EGM stores game program code, a hash function, and an authentication hash (which may be encrypted). Before executing the game program code, the EGM hashes the game program code using the hash function to obtain a result hash and compares the result hash to the authentication hash. If the result hash matches the authentication hash, the EGM determines that the game program code is valid and executes the game program code. If the result hash does not match the authentication hash, the EGM determines that the game program code has been altered (i.e., may have been tampered with) and prevents execution of the game program code. Examples of EGM code authentication are described in U.S. Pat. No. 6,962,530, entitled "Authentication in a Secure Computerized Gaming System"; U.S. Pat. No. 7,043,641, entitled "Encryption in a Secure Computerized Gaming System"; U.S. Pat. No. 7,201,662, entitled "Method and Apparatus for Software Authentication"; and U.S. Pat. No. 8,627,097, entitled "System and Method Enabling Parallel Processing of Hash Functions Using Authentication Checkpoint Hashes," which are incorporated herein by reference.

A fourth difference between EGMs and general purpose computing devices is that EGMs have unique peripheral device requirements that differ from those of a general purpose computing device, such as peripheral device security requirements not usually addressed by general purpose computing devices. For instance, monetary devices, such as coin dispensers, bill validators, and ticket printers and computing devices that are used to govern the input and output of cash or other items having monetary value (such as tickets) to and from an EGM have security requirements that are not typically addressed in general purpose computing devices. Therefore, many general purpose computing device techniques and methods developed to facilitate device connectivity and device compatibility do not address the emphasis placed on security in the gaming industry.

To address some of the issues described above, a number of hardware/software components and architectures are utilized in EGMs that are not typically found in general purpose computing devices. These hardware/software components and architectures, as described below in more detail, include but are not limited to watchdog timers, voltage monitoring systems, state-based software architecture and supporting hardware, specialized communication interfaces, security monitoring, and trusted memory.

Certain EGMs use a watchdog timer to provide a software failure detection mechanism. In a normally-operating EGM, the operating software periodically accesses control registers in the watchdog timer subsystem to "re-trigger" the watchdog. Should the operating software fail to access the control registers within a preset timeframe, the watchdog timer will timeout and generate a system reset. Typical watchdog timer circuits include a loadable timeout counter register to enable the operating software to set the timeout interval within a certain range of time. A differentiating feature of some circuits is that the operating software cannot completely disable the function of the watchdog timer. In other words, the watchdog timer always functions from the time power is applied to the board.

Certain EGMs use several power supply voltages to operate portions of the computer circuitry. These can be generated in a central power supply or locally on the computer board. If any of these voltages falls out of the tolerance limits of the circuitry they power, unpredictable operation of the EGM may result. Though most modern general purpose computing devices include voltage monitoring circuitry, these types of circuits only report voltage status to the operating software. Out of tolerance voltages can cause software malfunction, creating a potential uncontrolled condition in the general purpose computing device. Certain EGMs have power supplies with relatively tighter voltage margins than that required by the operating circuitry. In addition, the voltage monitoring circuitry implemented in certain EGMs typically has two thresholds of control. The first threshold generates a software event that can be detected by the operating software and an error condition then generated. This threshold is triggered when a power supply voltage falls out of the tolerance range of the power supply, but is still within the operating range of the circuitry. The second threshold is set when a power supply voltage falls out of the operating tolerance of the circuitry. In this case, the circuitry generates a reset, halting operation of the EGM.

As described above, certain EGMs are state-based machines. Different functions of the game provided by the EGM (e.g., bet, play, result, points in the graphical presentation, etc.) may be defined as a state. When the EGM moves a game from one state to another, the EGM stores critical data regarding the game software in a custom non-volatile memory subsystem. This ensures that the player's wager and credits are preserved and to minimize potential disputes in the event of a malfunction on the EGM. In general, the EGM does not advance from a first state to a second state until critical information that enables the first state to be reconstructed has been stored. This feature enables the EGM to recover operation to the current state of play in the event of a malfunction, loss of power, etc. that occurred just prior to the malfunction. In at least one embodiment, the EGM is configured to store such critical information using atomic transactions.

Generally, an atomic operation in computer science refers to a set of operations that can be combined so that they appear to the rest of the system to be a single operation with only two possible outcomes: success or failure. As related to data storage, an atomic transaction may be characterized as series of database operations which either all occur, or all do not occur. A guarantee of atomicity prevents updates to the database occurring only partially, which can result in data corruption.

To ensure the success of atomic transactions relating to critical information to be stored in the EGM memory before a failure event (e.g., malfunction, loss of power, etc.), memory that includes one or more of the following criteria be used: direct memory access capability; data read/write capability which meets or exceeds minimum read/write access characteristics (such as at least 5.08 Mbytes/sec (Read) and/or at least 38.0 Mbytes/sec (Write)). Memory devices that meet or exceed the above criteria may be referred to as "fault-tolerant" memory devices.

Typically, battery-backed RAM devices may be configured to function as fault-tolerant devices according to the above criteria, whereas flash RAM and/or disk drive memory are typically not configurable to function as fault-tolerant devices according to the above criteria. Accordingly, battery-backed RAM devices are typically used to preserve EGM critical data, although other types of non-volatile memory devices may be employed. These memory devices are typically not used in typical general purpose computing devices.

Thus, in at least one embodiment, the EGM is configured to store critical information in fault-tolerant memory (e.g., battery-backed RAM devices) using atomic transactions. Further, in at least one embodiment, the fault-tolerant memory is able to successfully complete all desired atomic transactions (e.g., relating to the storage of EGM critical information) within a time period of 200 milliseconds or less. In at least one embodiment, the time period of 200 milliseconds represents a maximum amount of time for which sufficient power may be available to the various EGM components after a power outage event has occurred at the EGM.

As described previously, the EGM may not advance from a first state to a second state until critical information that enables the first state to be reconstructed has been atomically stored. After the state of the EGM is restored during the play of a game of chance, game play may resume and the game may be completed in a manner that is no different than if the malfunction had not occurred. Thus, for example, when a malfunction occurs during a game of chance, the EGM may be restored to a state in the game of chance just prior to when the malfunction occurred. The restored state may include metering information and graphical information that was displayed on the EGM in the state prior to the malfunction. For example, when the malfunction occurs during the play of a card game after the cards have been dealt, the EGM may be restored with the cards that were previously displayed as part of the card game. As another example, a bonus game may be triggered during the play of a game of chance in which a player is required to make a number of selections on a video display screen. When a malfunction has occurred after the player has made one or more selections, the EGM may be restored to a state that shows the graphical presentation just prior to the malfunction including an indication of selections that have already been made by the player. In general, the EGM may be restored to any state in a plurality of states that occur in the game of chance that occurs while the game of chance is played or to states that occur between the play of a game of chance.

Game history information regarding previous games played such as an amount wagered, the outcome of the game, and the like may also be stored in a non-volatile memory device. The information stored in the non-volatile memory may be detailed enough to reconstruct a portion of the graphical presentation that was previously presented on the EGM and the state of the EGM (e.g., credits) at the time the game of chance was played. The game history information may be utilized in the event of a dispute. For example, a player may decide that in a previous game of chance that they did not receive credit for an award that they believed they won. The game history information may be used to reconstruct the state of the EGM prior to, during, and/or after the disputed game to demonstrate whether the player was correct or not in her assertion. Examples of a state-based EGM, recovery from malfunctions, and game history are described in U.S. Pat. No. 6,804,763, entitled "High Performance Battery Backed RAM Interface"; U.S. Pat. No. 6,863,608, entitled "Frame Capture of Actual Game Play"; U.S. Pat. No. 7,111,141, entitled "Dynamic NV-RAM"; and U.S. Pat. No. 7,384,339, entitled, "Frame Capture of Actual Game Play," which are incorporated herein by reference.

Another feature of EGMs is that they often include unique interfaces, including serial interfaces, to connect to specific subsystems internal and external to the EGM. The serial devices may have electrical interface requirements that differ from the "standard" EIA serial interfaces provided by general purpose computing devices. These interfaces may include, for example, Fiber Optic Serial, optically coupled serial interfaces, current loop style serial interfaces, etc. In addition, to conserve serial interfaces internally in the EGM, serial devices may be connected in a shared, daisy-chain fashion in which multiple peripheral devices are connected to a single serial channel.

The serial interfaces may be used to transmit information using communication protocols that are unique to the gaming industry. For example, IGT's Netplex is a proprietary communication protocol used for serial communication between EGMs. As another example, SAS is a communication protocol used to transmit information, such as metering information, from an EGM to a remote device. Often SAS is used in conjunction with a player tracking system.

Certain EGMs may alternatively be treated as peripheral devices to a casino communication controller and connected in a shared daisy chain fashion to a single serial interface. In both cases, the peripheral devices are assigned device addresses. If so, the serial controller circuitry must implement a method to generate or detect unique device addresses. General purpose computing device serial ports are not able to do this.

Security monitoring circuits detect intrusion into an EGM by monitoring security switches attached to access doors in the EGM cabinet. Access violations result in suspension of game play and can trigger additional security operations to preserve the current state of game play. These circuits also function when power is off by use of a battery backup. In power-off operation, these circuits continue to monitor the access doors of the EGM. When power is restored, the EGM can determine whether any security violations occurred while power was off, e.g., via software for reading status registers. This can trigger event log entries and further data authentication operations by the EGM software.

Trusted memory devices and/or trusted memory sources are included in an EGM to ensure the authenticity of the software that may be stored on less secure memory subsystems, such as mass storage devices. Trusted memory devices and controlling circuitry are typically designed to not enable modification of the code and data stored in the memory device while the memory device is installed in the EGM. The code and data stored in these devices may include authentication algorithms, random number generators, authentication keys, operating system kernels, etc. The purpose of these trusted memory devices is to provide gaming regulatory authorities a root trusted authority within the computing environment of the EGM that can be tracked and verified as original. This may be accomplished via removal of the trusted memory device from the EGM computer and verification of the secure memory device contents is a separate third party verification device. Once the trusted memory device is verified as authentic, and based on the approval of the verification algorithms included in the trusted device, the EGM is enabled to verify the authenticity of additional code and data that may be located in the gaming computer assembly, such as code and data stored on hard disk drives. Examples of trusted memory devices are described in U.S. Pat. No. 6,685,567, entitled "Process Verification," which is incorporated herein by reference.

In at least one embodiment, at least a portion of the trusted memory devices/sources may correspond to memory that cannot easily be altered (e.g., "unalterable memory") such as EPROMS, PROMS, Bios, Extended Bios, and/or other memory sources that are able to be configured, verified, and/or authenticated (e.g., for authenticity) in a secure and controlled manner.

According to one embodiment, when a trusted information source is in communication with a remote device via a network, the remote device may employ a verification scheme to verify the identity of the trusted information source. For example, the trusted information source and the remote device may exchange information using public and private encryption keys to verify each other's identities. In another embodiment, the remote device and the trusted information source may engage in methods using zero knowledge proofs to authenticate each of their respective identities.

EGMs storing trusted information may utilize apparatuses or methods to detect and prevent tampering. For instance, trusted information stored in a trusted memory device may be encrypted to prevent its misuse. In addition, the trusted memory device may be secured behind a locked door. Further, one or more sensors may be coupled to the memory device to detect tampering with the memory device and provide some record of the tampering. In yet another example, the memory device storing trusted information might be designed to detect tampering attempts and clear or erase itself when an attempt at tampering has been detected. Examples of trusted memory devices/sources are described in U.S. Pat. No. 7,515,718, entitled "Secured Virtual Network in a Gaming Environment," which is incorporated herein by reference.

Mass storage devices used in a general purpose computing devices typically enable code and data to be read from and written to the mass storage device. In a gaming environment, modification of the gaming code stored on a mass storage device is strictly controlled and would only be enabled under specific maintenance type events with electronic and physical enablers required. Though this level of security could be provided by software, EGMs that include mass storage devices include hardware level mass storage data protection circuitry that operates at the circuit level to monitor attempts to modify data on the mass storage device and will generate both software and hardware error triggers should a data modification be attempted without the proper electronic and physical enablers being present. Examples of using a mass storage device are described in U.S. Pat. No. 6,149,522, entitled "Method of Authenticating Game Data Sets in an Electronic Casino Gaming System," which is incorporated herein by reference.

It should be understood that various changes and modifications to the presently preferred embodiments described herein will be apparent to those skilled in the art. Such changes and modifications can be made without departing from the spirit and scope of the present invention and without diminishing its intended advantages. It is therefore intended that such changes and modifications be covered by the appended claims.

The invention is claimed as follows:

1. A gaming system comprising:

at least one processor; and at least one memory device which stores a plurality of instructions, which when executed by the at least one processor, cause the at least one processor to:

for a play of a first skill-based game associated with one of a plurality of tiers:

enable a player associated with said one of the plurality of tiers to make at least one skill input, determine, based at least in part on the at least one skill input made by the player, any award to provide the player, cause at least one display device to display any determined award, and determine, based at least in part on the at least one skill input made by the player, whether to advance the player to another one of the plurality of tiers associated with another a subsequent play of a second skill-based game, and upon an occurrence of a progressive award sequence triggering event associated with a progressive award selected from a plurality of progressive awards, wherein each of the progressive awards is associated with one of the plurality of tiers:

determine a quantity of players associated with the tier of the selected progressive award, responsive to the quantity of players associated with the tier of the selected progressive award being zero, not trigger any progressive award sequence in association with the occurrence of the progressive award sequence triggering event, responsive to the quantity of players associated with the tier of the selected progressive award being one, enable one player to participate in a single player progressive award sequence to determine, based at least in part on at least one skill input made by that player during the single player progressive award sequence, whether to provide that player the selected progressive award, and responsive to the quantity of players associated with the tier of the selected progressive award being at least two, enable each of said at least two players to participate in a multiple player progressive award sequence to select, based at least in part on at least one skill input made by each of the at least two players during the multiple player progressive award sequence, one of the at least two players to be provided the selected progressive award.

2. The gaming system of claim 1, wherein the first skill-based game occurs upon a placement of a wager.

3. The gaming system of claim 2, wherein a first placed wager amount is associated with a first probability of being provided the selected progressive award in association with the at least one skill input made during the single player progressive award sequence and a second, greater placed wager amount is associated with a second, greater probability of being provided the selected progressive award in association with the at least one skill input made during the single player progressive award sequence.

4. The gaming system of claim 2, wherein responsive to a first player of the at least two players having placed a first wager amount, a second player of the at least two players having placed a second, greater wager amount and the first player and second player having made a same at least one skill input during the multiple player progressive award sequence, the first player has a first probability of being selected to be provided the selected progressive award in association with the multiple player progressive award sequence and the second player has a second, greater probability of being selected to be provided the selected progressive award in association with the multiple player progressive award sequence.

5. The gaming system of claim 1, wherein each skill input is selected from the group consisting of: a quantifiable timing input, a quantifiable aiming input, a quantifiable physical strength input, a quantifiable knowledge input, a quantifiable reasoning input, and a quantifiable strategy input.

6. The gaming system of claim 1, which includes a plurality of input devices including an acceptor, and a cashout device, wherein when executed by the at least one processor, the plurality of instructions cause the at least one processor to: responsive to a physical item being received via the acceptor, establish a credit balance based, at least in part, on a monetary value associated with the received physical item, and responsive to a cashout input being received via the cashout device, cause an initiation of any payout associated with the credit balance.

7. The gaming system of claim 1, wherein at least one of any determined award and the selected progressive award is selected from the group consisting of: a quantity of monetary credits, a quantity of non-monetary credits, a quantity of promotional credits, and a quantity of player tracking points.

8. A gaming system server comprising:

at least one processor; and at least one memory device which stores a plurality of instructions, which when executed by the at least one processor, cause the at least one processor to:

for a play of a first skill-based game associated with one of a plurality of tiers:

receive data associated with at least one skill input made by a player associated with said one of the plurality of tiers, determine, based at least in part on the at least one skill input made by the player, any award to provide the player, communicate data which results in at least one display device displaying any determined award, and determine, based at least in part on the at least one skill input made by the player, whether to advance the player to another one of the plurality of tiers associated with a subsequent play of a second another skill-based game, and upon an occurrence of a progressive award sequence triggering event associated with a progressive award selected from a plurality of progressive awards, wherein each of the progressive awards is associated with one of the plurality of tiers:

determine a quantity of players associated with the tier of the selected progressive award, responsive to the quantity of players associated with the tier of the selected progressive award being zero, not trigger any progressive award sequence in association with the occurrence of the progressive award sequence triggering event, responsive to the quantity of players associated with the tier of the selected progressive award being one, enable one player to participate in a single player progressive award sequence to determine, based at least in part on at least one skill input made by that player during the single player progressive award sequence, whether to provide that player the selected progressive award, and responsive to the quantity of players associated with the tier of the selected progressive award being at least two, enable each of said at least two players to participate in a multiple player progressive award sequence to select, based at least in part on at least one skill input made by each of the at least two players during the multiple player progressive award sequence, one of the at least two players to be provided the selected progressive award.

9. The gaming system server of claim 8, wherein the first skill-based game occurs upon a placement of a wager.

10. The gaming system server of claim 9, wherein a first placed wager amount is associated with a first probability of being provided the selected progressive award in association with the at least one skill input made during the single player progressive award sequence and a second, greater placed wager amount is associated with a second, greater probability of being provided the selected progressive award in association with the at least one skill input made during the single player progressive award sequence.

11. The gaming system server of claim 9, wherein if responsive to a first player of the at least two players having placed a first wager amount, a second player of the at least two players having placed a second, greater wager amount and the first player and second player having made a same at least one skill input during the multiple player progressive award sequence, the first player has a first probability of being selected to be provided the selected progressive award in association with the multiple player progressive award sequence and the second player has a second, greater probability of being selected to be provided the selected progressive award in association with the multiple player progressive award sequence.

12. The gaming system server of claim 8, wherein each skill input is selected from the group consisting of: a quantifiable timing input, a quantifiable aiming input, a quantifiable physical strength input, a quantifiable knowledge input, a quantifiable reasoning input, and a quantifiable strategy input.

13. The gaming system server of claim 8, wherein a credit balance is increasable based on any displayed awards, said credit balance being increasable via an acceptor of a physical item associated with a monetary value, and said credit balance being decreasable via a cashout device.

14. The gaming system server of claim 8, wherein at least one of any determined award and the selected progressive award is selected from the group consisting of: a quantity of monetary credits, a quantity of non-monetary credits, a quantity of promotional credits, and a quantity of player tracking points.

15. A method of operating a gaming system, said method comprising:

for a play of a first skill-based game associated with one of a plurality of tiers:

enabling a player associated with said one of the plurality of tiers to make at least one skill input, determining, by at least one processor and based at least in part on the at least one skill input made by the player, any award to provide the player, displaying, by at least one display device, any determined award, and determining, by the at least one processor and based at least in part on the at least one skill input made by the player, whether to advance the player to another one of the plurality of tiers associated with a subsequent play of a second another skill-based game, and upon an occurrence of a progressive award sequence triggering event associated with a progressive award selected from a plurality of progressive awards, wherein each of the progressive awards is associated with one of the plurality of tiers:

determining, by the at least one processor, a quantity of players associated with the tier of the selected progressive award, responsive to the quantity of players associated with the tier of the selected progressive award being zero, not triggering any progressive award sequence in association with the occurrence of the progressive award sequence triggering event, responsive to the quantity of players associated with the tier of the selected progressive award being one, enabling one player to participate in a single player progressive award sequence to determine, based at least in part on at least one skill input made by that player during the single player progressive award sequence, whether to provide that player the selected progressive award, and responsive to the quantity of players associated with the tier of the selected progressive award being at least two, enabling each of said at least two players to participate in a multiple player progressive award sequence to select, based at least in part on at least one skill input made by each of the at least two players during the multiple player progressive award sequence, one of the at least two players to be provided the selected progressive award.

16. The method of claim 15, wherein the first skill-based game occurs upon a placement of a wager.

17. The method of claim 16, wherein a first placed wager amount is associated with a first probability of being provided the selected progressive award in association with the at least one skill input made during the single player progressive award sequence and a second, greater placed wager amount is associated with a second, greater probability of being provided the selected progressive award in association with the at least one skill input made during the player progressive award sequence.

18. The method of claim 16, wherein responsive to a first player of the at least two players having placed a first wager amount, a second player of the at least two players having placed a second, greater wager amount and the first player and second player having made a same at least one skill input during the multiple player progressive award sequence, the first player has a first probability of being selected to be provided the selected progressive award in association with the multiple player progressive award sequence and the second player has a second, greater probability of being selected to be provided the selected progressive award in association with the multiple player progressive award sequence.

19. The method of claim 15, wherein each skill input is selected from the group consisting of: a quantifiable timing input, a quantifiable aiming input, a quantifiable physical strength input, a quantifiable knowledge input, a quantifiable reasoning input, and a quantifiable strategy input.

20. The method of claim 15, wherein a credit balance is increasable based on any displayed awards, said credit balance being increasable via an acceptor of a physical item associated with a monetary value, and said credit balance being decreasable via a cashout device.

21. The method of claim 15, wherein at least one of any determined award and the selected progressive award is selected from the group consisting of: a quantity of monetary credits, a quantity of non-monetary credits, a quantity of promotional credits, and a quantity of player tracking points.

* * * * *